US006375630B1

(12) United States Patent
Cutler et al.

(10) Patent No.: US 6,375,630 B1
(45) Date of Patent: Apr. 23, 2002

(54) MICROCONTROLLER BASED MASSAGE SYSTEM

(75) Inventors: Stanley Cutler, Van Nuys; Gayle B. Gerth, Dana Point, both of CA (US); Alton B. Otis, Jr., Port Townsend, WA (US); Taylor Chau, Cerritos, CA (US)

(73) Assignee: InSeat Solutions, LLC

( * ) Notice: Subject to any disclaimer, the term of this patent is extended or adjusted under 35 U.S.C. 154(b) by 0 days.

(21) Appl. No.: 09/071,357

(22) Filed: Apr. 28, 1998

(51) Int. Cl.[7] ..... A61H 23/02
(52) U.S. Cl. ..... 601/57; 601/70
(58) Field of Search ..... 601/46–54, 56–61, 601/64, 65, 69, 70, 84, 78, 86, 90, 98, 107, 108, 111

(56) References Cited

U.S. PATENT DOCUMENTS 4,779,615 A * 10/1988 Frazier ..... 601/47
5,188,096 A * 2/1993 Yoo ..... 601/57
5,452,205 A * 9/1995 Telepko ..... 601/84 X
5,713,832 A * 2/1998 Jain ..... 601/60 X

* cited by examiner

*Primary Examiner*—Danton D. DeMille

(74) *Attorney, Agent, or Firm*—Fulwider Patton Lee & Utecht, LLP

(57) ABSTRACT

A massaging system includes a pad; a heater element, and motorized vibrators in respective regions of the pad; corresponding heater and motor drivers in the pad; a control wand removably connectable to the pad and having a microcontroller with RAM and ROM, a serial EEPROM; a serial interface to a shift register in the pad for signaling pulse width modulation of the drivers. The ROM defines a master set of operating modes and variations thereof in response to operator input of intensity, region, heat input; and mode signals to the controller. The EEPROM has data for implementing and configuring a subset of the master modes. The system can also provide composite modes including a test mode that automatically sequentially activates each mode and variation of the subset of the modes without delays for exercising non-implemented modes. The system can have a power detector for identifying sources of power having different current limitations, the system being operated with PWM duty cycle limiting when raw power voltage falls below a preset level. Also disclosed is a set-up method for writing data to the EEPROM using the serial interface when the wand is disconnected from the pad for facilitating production of a variety of systems with reduced inventory requirements. The system can also include an audio envelope detector having a dual-slope integrating ADC in the pad that is cycled by serial signals driving the shift register, a single comparator output of the ADC signaling the microcontroller.

32 Claims, 10 Drawing Sheets

MICROCONTROLLER BASED MASSAGE SYSTEM

REFERENCE TO APPENDIX

Attached hereto and incorporated herein is Appendix A, which is the hard copy printout of an assembly listing (Samsung Assembly Language) of the source code for a microcontroller computer program as disclosed herein to implement the invention described herein. Appendix A consists of 87 pages. This assembly listing is subject to copyright protection. The copyright owner has no objection to the facsimile reproduction of the patent disclosure, as it appears in the Patent and Trademark Office patent files or records, but otherwise reserves copyright rights whatsoever.

BACKGROUND

The present invention relates to a massaging apparatus, and more particularly to an improved microcontroller based controller for such apparatus. Recent developments in massaging apparatus have produced a variety of products incorporating plural vibration transducers that operate in multiple modes. In general, more sophistication in the massaging and heating of the body is desired, not only as a sales tactic but also and, perhaps more importantly, as an adjunct to medical treatment.

The increased sophistication tends to drive up costs, particularly when product variations must be supported by diverse inventories, and new developments make existing products obsolete. Thus there is a need for a massage system having further improved operating modes with increased utilization of existing inventories and shorter lead times in commercial production of products having greater sophistication. There is a further need that the system be reliable, easy to operate and inexpensive to produce.

SUMMARY

The present invention provides a microcontroller based massage system utilizing small DC motors with eccentric mass elements as the vibratory source. The motors are embedded in a pad upon which the user lies or reclines. The pad may also contain embedded heaters to enhance the massage. The system is activated via a remote control device containing key switches or push buttons and visual status indicators. The wand connects to the massage pad via a serial interface cable. The wand and massage pad are powered from either a wall transformer or a battery, the latter affording portable operation. In its fullest implementation, the massage pad is body length and contains a plurality of motors and heaters. Typically, the heaters are located in the center of the shoulder and lower back areas and the motors are located in five zones distributed over the body length. Several advantages are derived from this arrangement. Computerizing the various modes and operations facilitates the use of the massaging and heating apparatus. Thus, the user can experience a wider variety of massage. A larger variety of options of vibrating sources and how they inter-operate is made available. Total operational variety is simpler to obtain through computer programming than manually.

In one aspect of the invention, a computer controlled massaging system includes a pad for contacting a user of the system; a plurality of vibratory transducers for deflecting respective regions of the pad, each transducer being responsive to a transducer power signal; a microprocessor controller having associated therewith an input and output interface, and memory including read-only program memory (ROM), non-volatile programmable parameter memory (PROM), and variable memory (RAM); an array of input elements connected to the input interface for signaling the microprocessor in response to operator input, the signaling including signals for setting a plurality of operating modes, at least one region signal relating transducers to be activated in the plurality of modes, and signals for setting an intensity control value; and a plurality of transducer drivers responsive to the output interface for producing, separately for each of the transducers, the power signal; the ROM having a set of instructions stored therein to be used by the microprocessor for implementing a master set of modes including a composite mode incorporating a plurality of other modes of the master set, and for interrogating the PROM; and the PROM having parameters stored therein for enabling a predetermined complement of the master modes, wherein the microprocessor generates the plurality of operating modes in response to the input elements, to the exclusion of all but the predetermined complement and, when the predetermined complement includes the composite mode, the microprocessor generates the composite mode in response to the input elements while skipping those portions of the composite mode that are not included in the predetermined complement of the master modes.

The PROM can be electrically programmable, the microprocessor controller being configured for programming the PROM with the parameters in response to external signals. Preferably the PROM is a serial EEPROM having two signal connections only with the microprocessor for effecting both the programming of the configuration data therein and reading the data therefrom. The microprocessor controller and the input elements can be located in a control module external of the pad, the transducer drivers being located within the pad, the control module having a plug connection for signaling the transducer drivers, the plug connection being configured for receiving the external signals when the plug connection is disconnected from the transducer drivers.

Preferably the massaging system further includes a shift register connected between the plug connection and the transducer drivers that is repetitively loaded by serial data transfers using not more than two serial output signals and a buffer strobe signal from the microprocessor through the plug connection for defining respective pulse width modulation duty cycles of the transducer drivers. The system can further include a timer for inhibiting outputs of the shift register when more than a predetermined interval passes between successive serial data transfers from the microprocessor to the shift register. The system can further include an audio input connection for receiving an audio signal, an envelope detector for repetitively signaling measured amplitudes of the audio signal to the microprocessor, the system selectively activating the transducers variably in response to the envelope detector, the envelope detector including an integrating analog to digital converter (ADC) having a comparator output to the microprocessor, the ADC being cycled by the not more than two serial output signals. The envelope detector can include a peak detector that is periodically reset by an output bit of the shift register.

The massaging system can further include a heater element in the pad, and a heater driver connected between the shift register and the heater element for selectively activating the heater element at low and high power levels in response to serial data transfers from the microprocessor. The heat control input can have off, low, and high states for selectively powering the heater at high power, low power, and no power, the microprocessor controller being operative for activating the heater driver to power the heater element at high power when the heat control input is high, at no power when the heat control input is off, and at low power when the heat control input is low, except that when the heat control input is changed from off to low, the microprocessor controller being operative for powering the heater at high power for a warm up interval of time prior to the low power, the warm up interval being dependent on a time interval of the off state of the control input.

In another aspect of the invention, the massaging system includes the pad, the plurality of transducers, a microprocessor controller having program and variable memory and an input and output interface; an array of input elements connected to the input interface for signaling the microprocessor in response to operator input, the signaling including an intensity control value and at least one region signal relating transducers to be activated; the plurality of transducer drivers; means for powering the microprocessor and the drivers from a first source of electrical power, the first source having a voltage drop as loads are added; and means for limiting each of the power signals to a signal upper limit being inversely related to the source voltage for preventing overloading of the power source.

The massaging system can be used additionally with a second power source that does not have a voltage drop as great as the voltage drop of the first source as loads are added, the system further including a power detector for sensing whether the second power source is being used, the microprocessor being programmed for selectively limiting the power signals in response to the power detector. One of the power sources can be AC, the other DC, the power detector including an inverter having a square wave output when the power source is AC and a level output when the power source is DC, the microprocessor being responsive to the output of the power detector.

In another aspect of the invention, the massaging system includes the pad; a vibratory transducer for vibrating the pad and including a motor having a mass element eccentrically coupled thereto that is responsive to a motor power signal; a control microprocessor having program and variable memory, and an input-output interface; an array of input elements connected to the microprocessor for signaling the microprocessor in response to operator input, the signaling including an audio mode signal; a motor driver responsive to the input-output interface for producing the power signal for the motor; an audio detector for detecting an audio envelope of an audio input signal, including a peak detector having a reset input, and an analog to digital converter having a switching circuit, a differential integrator, and a comparator, the integrator having a sample connection configuration and a discharge connection configuration being defined in response to the switching circuit; wherein the microprocessor controller is operative for cycling the switching circuit and generating the motor power signal in response to the audio envelope.

The transducer can be in an array of transducers, the motor driver being one of a corresponding plurality of motor drivers, the system further including a serial communication interface between the microprocessor controller and the drivers, the interface having respective serial data, strobe, and clock outputs of the controller, and a converter input to the controller from the comparator; a shift register driven in response to the serial outputs for signaling the driver circuits and the reset input of the peak detector; and wherein the switching circuit is operable in response to the serial outputs.

In a further aspect of the invention, the massaging system includes the pad; a plurality of vibratory transducers for vibrating respective regions of the pad, each region having left and right ones of the transducers, each transducer being responsive to a transducer power signal; a microprocessor controller having program and variable memory and an input and output interface; an array of input elements connected to the input interface for signaling the microprocessor in response to operator input, the signaling including a plurality of region signals relating transducers to be activated, and a plurality of mode signals; a plurality of transducer drivers responsive to the output interface for producing, separately for each of the transducers, the power signal; and the microprocessor controller being operative in response to the input elements for activating the transducers for operation thereof in a plurality of modes, and in a first composite mode wherein each of the plurality of modes is activated sequentially, the first composite mode automatically terminating upon completion thereof, and a second composite mode continuously repeating repeating the first composite mode. The signaling can include signals for setting an intensity control value, and the transducers are preferably activated at power levels responsive to the intensity control value in at least some of the modes, including at least one of the composite modes for facilitating testing and/or demonstration of the system at variable power levels. The signaling can include signals for setting a speed control value for determining a rate of sequencing mode component intervals, and wherein, during at least one of the composite modes, the duration of operation in sequential activation of modes is responsive to the speed control value. The input elements can further define a heat control input, the system further including a heater element in the pad; a heater driver responsive to the output interface for powering the heater, the microprocessor being further operative in response to the input elements for activating the heater element, and wherein at least one of the composite modes includes activation of the heater element.

Preferably at least some of the modes are altered upon repeated occurrences of same mode input signals for enhanced control versatility. The mode signals can include a zig-zag signal, the microprocessor being operative in response to the zig-zag signal for activating alternating left and right ones of the transducers in sequential zones. The microprocessor can be operative in response to repeated occurrences of the zig-zag signal for selectively activating the transducers in: shoelace pattern wherein diagonal pairs of the transducers are activated in a repeating pattern; a first alternating zig-zag pattern of left and right transducers in adjacent regions, followed by a second alternating pattern being a mirror image of the first; and an alternating repetitive pattern in one region, the pattern sequentially advancing among the regions.

The mode signals can include a circle signal, the microprocessor being operative in response to the circle signal for activating an alternating pattern of the transducers, the pattern periodically advancing in a closed path among the transducers. The microprocessor can be operative in response to repeated occurrences of the circle signal for selectively activating the transducers in: a circle pattern wherein the pattern is circular, advancing between the left transducers in one direction and the right transducers in the opposite direction; a circle pattern advancing oppositely of the previous pattern; and a figure-eight pattern.

The mode signals can include a program signal, the microprocessor being operative in response to the program signal for setting a relative power level for the transducers separately for each of the regions in response to the intensity control value and respective ones of the region signals. The microprocessor can be operative in response to repeated occurrences of the program signal for: changing custom settings of individual regions; permitting operation in other modes while maintaining relative power levels of the regions corresponding to the custom settings; and permitting operation in other modes without the custom settings, the custom settings being preserved until being changed following a subsequent occurrence of the program signal.

Preferably the massaging system further includes a non-volatile parameter memory for storing and signaling to the microprocessor controller particular functions being implemented in the system for utilizing a single set of programmed instructions in the program memory in variously configured examples of the massaging system. The program memory can define the first composite mode as a master set of modes and functions in accordance with substantially every state of the region signals and the mode signals, the composite mode being responsive to data of the parameter memory for skipping non-implemented modes and functions of the system.

In another aspect of the invention, a method for configuring a massaging system having a pad having a plurality of vibrators in respective regions of the pad, a microprocessor control module including ROM firmware, non-volatile parameter memory, and a communication interface, and drivers for the vibrators being electrically connectable by the communication interface with the microprocessor, includes the steps of:

(a) providing a set-up unit having means for receiving parameter data;

(b) connecting the set-up unit to the communication interface of the control module;

(c) feeding the parameter data to the microprocessor using the communication interface;

(d) writing the parameter data into the parameter memory using a portion of the ROM firmware, thereby to configure the system; and (e) disconnecting the set-up unit from the communication interface.

The method can include the further steps of:

(a) loading the parameter data into the set-up unit using a script file;

(b) powering the control module from the set-up unit subsequent to the step of loading the parameter data; and (c) the step of feeding the parameter data including momentarily asserting a signal of the communication interface simultaneously with the step of powering the control module for triggering the ROM firmware portion; feeding portions of the data sequentially on the communication interface in response to respective request signals from the microprocessor; and removing power from the control module subsequent to the step of writing the parameter data thereby to terminate the configuring.

The method can include the further step of connecting the drivers to the communication interface for enabling normal operation of the massaging system using the configuration data.

DRAWINGS

These and other features, aspects, and advantages of the present invention will become better understood with reference to the following description, appended claims, and accompanying drawings, where:

Figure 1:
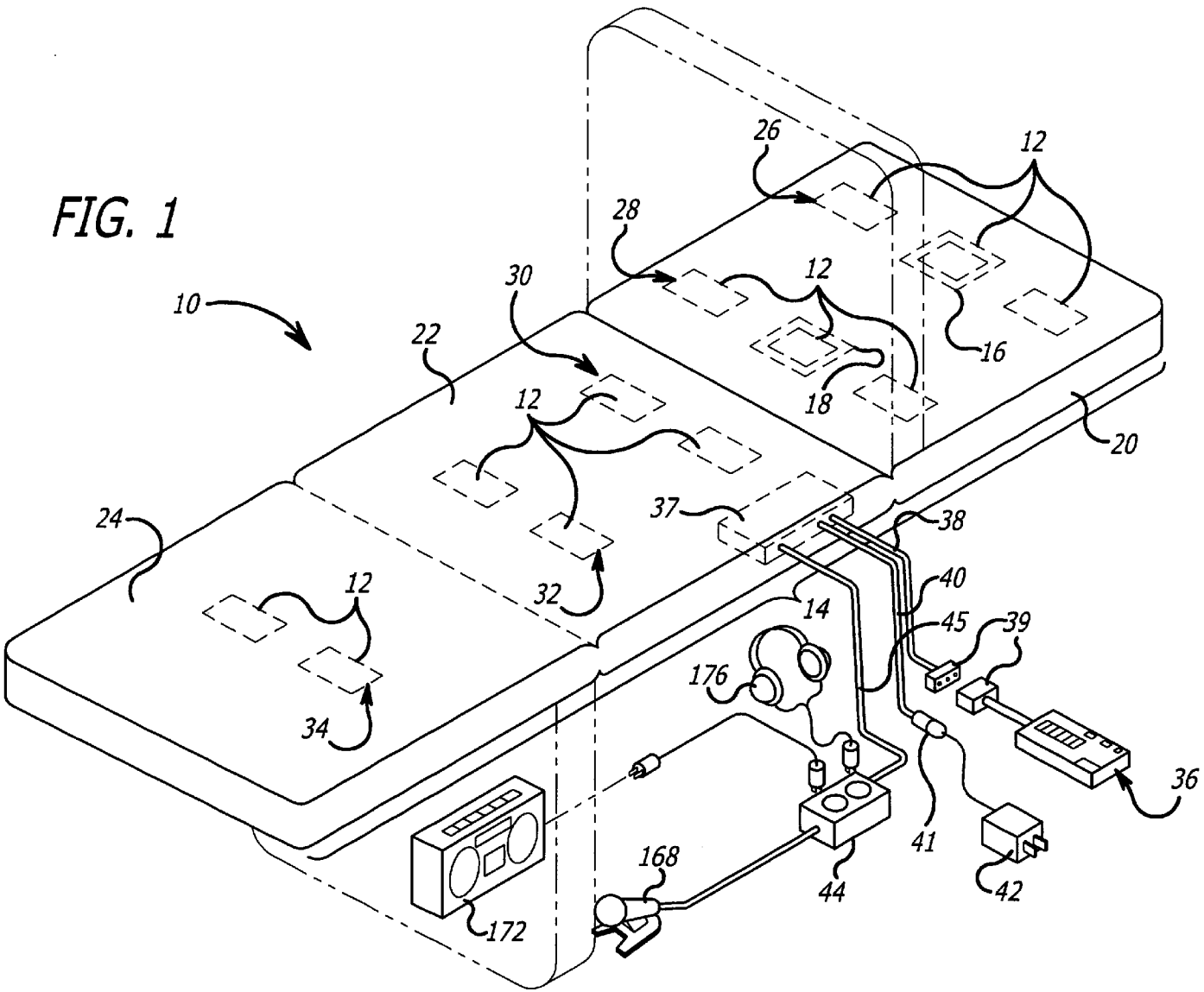
FIG. 1 is a perspective view of a massaging system according to the present invention.
Figure 2:
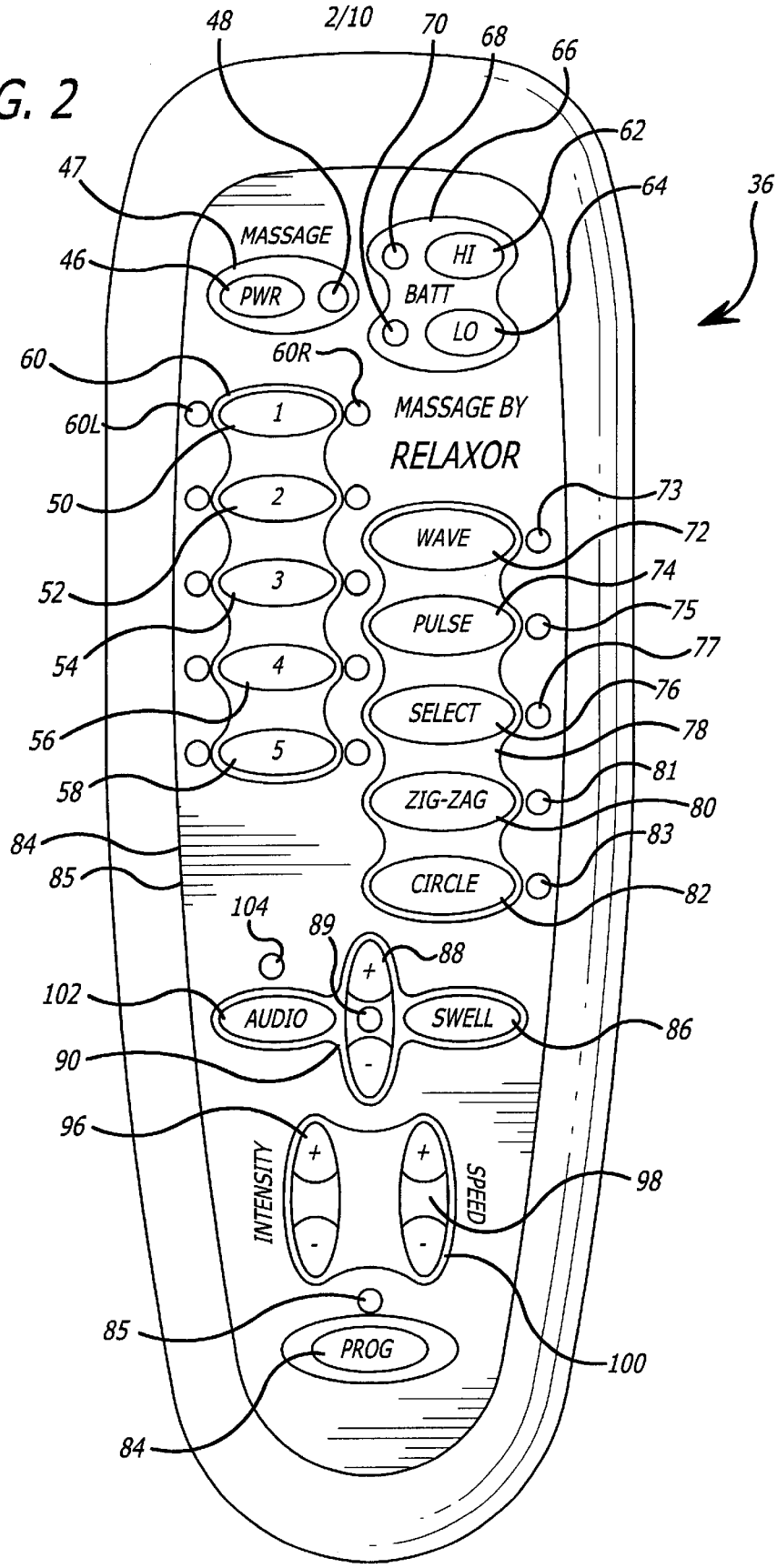
FIG. 2 is an enlarged view of a controller portion of the system of FIG. 1.
Figure 3A:
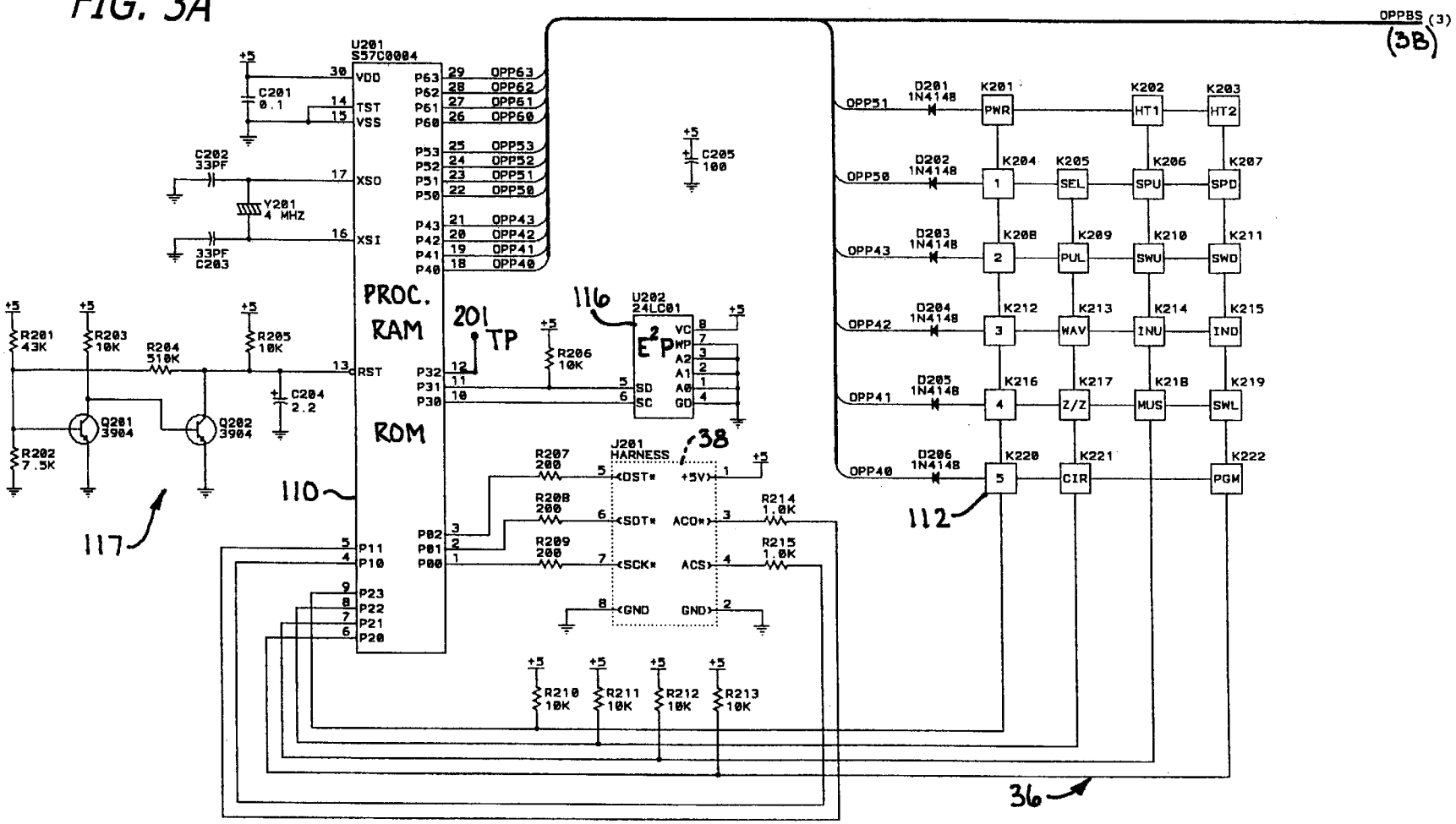
Figure 3B:
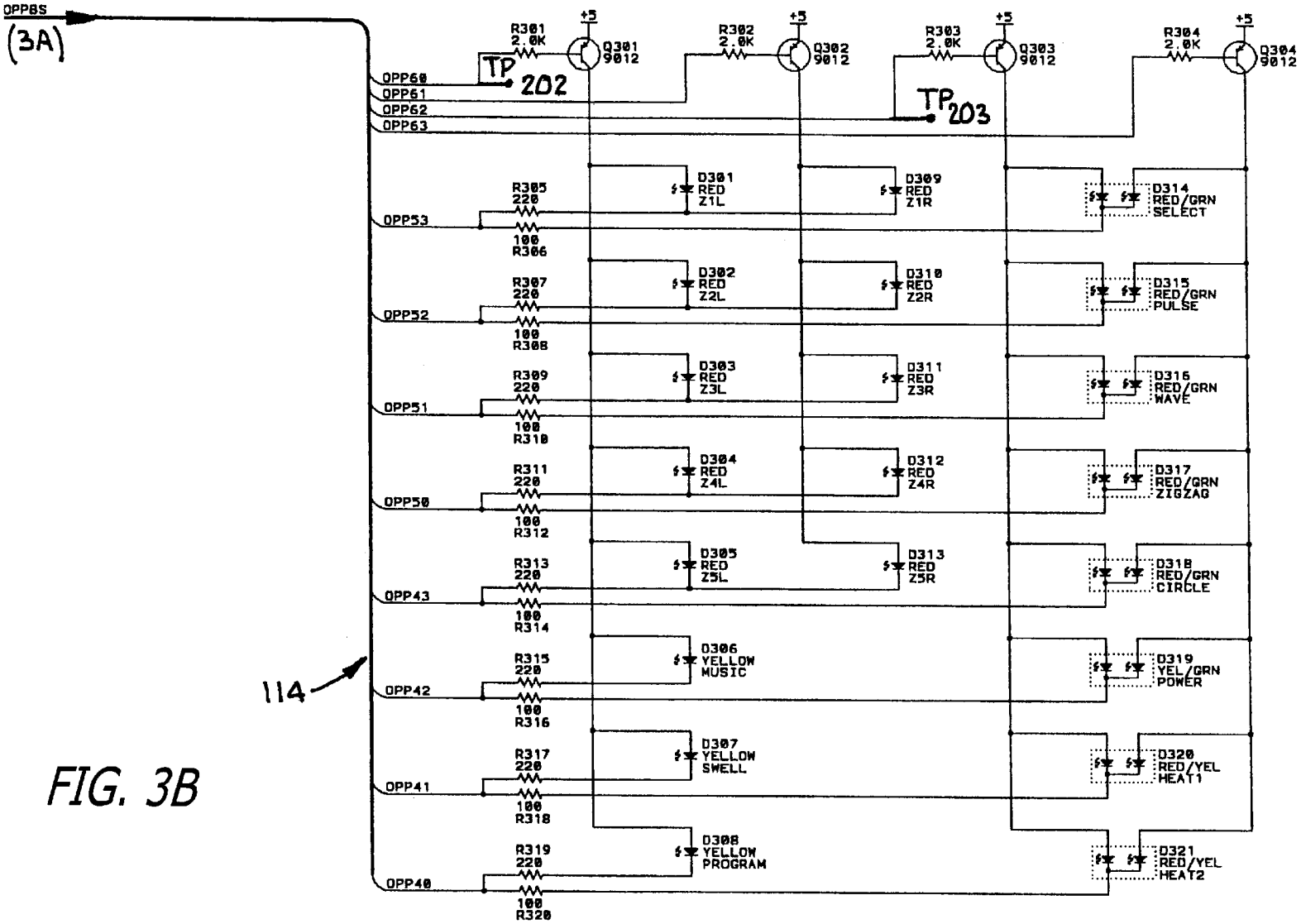
Figure 5:
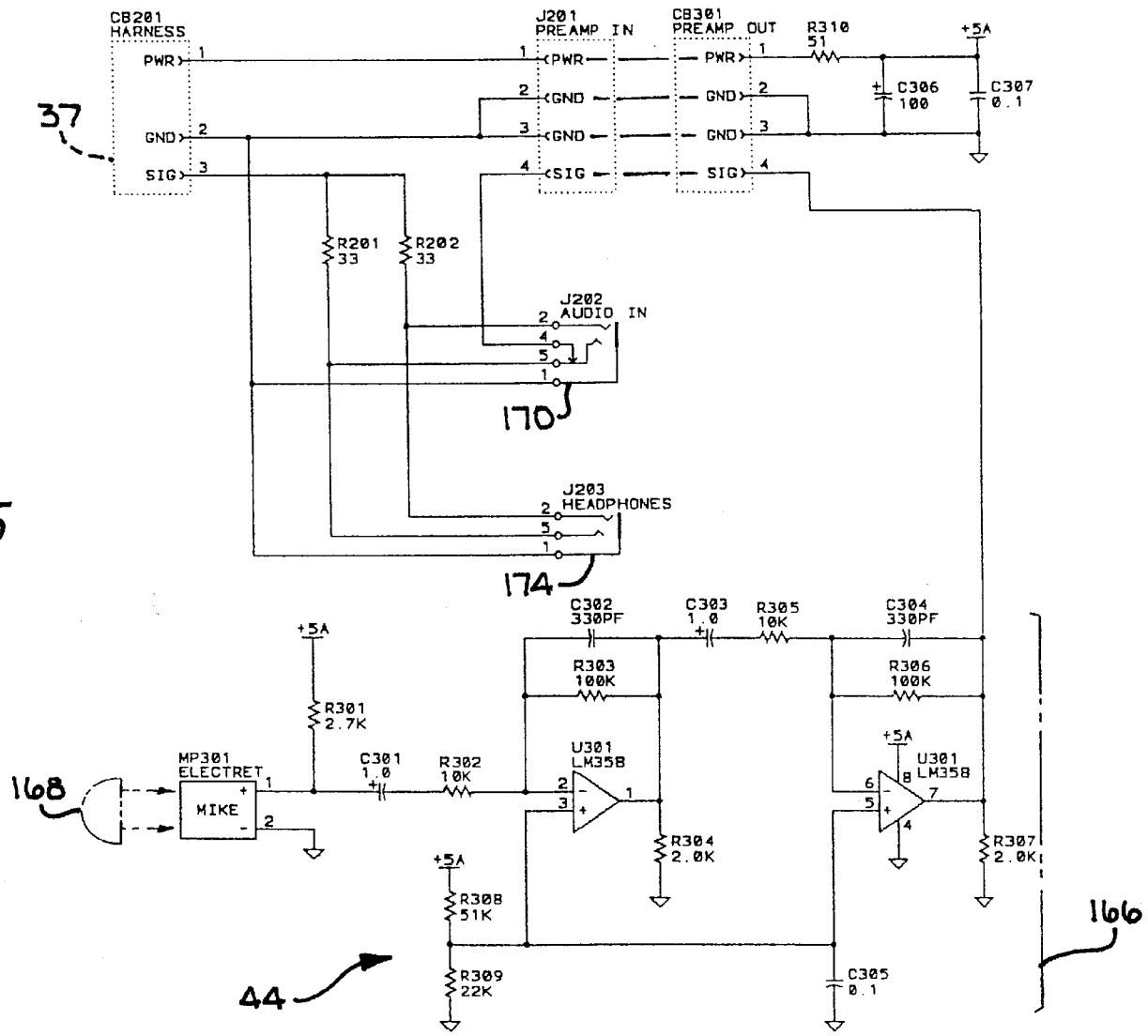
Figure 6:
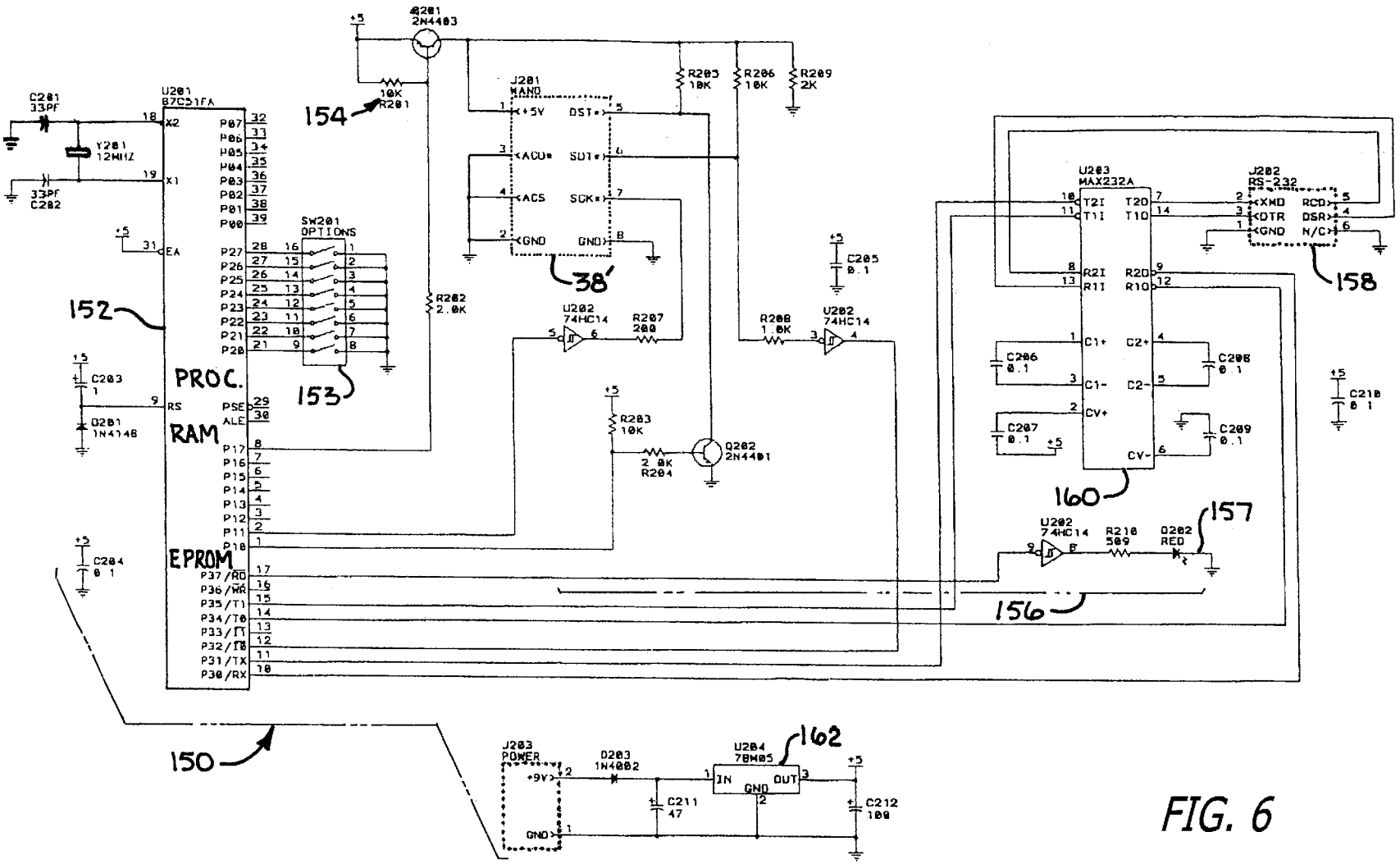

FIG. 3 (presented on separate sheets as FIGS. 3A and 3B) is a circuit diagram detailing the controller portion of FIG. 2;

FIG. 4 (presented on separate sheets as FIGS. 4A, 4B, 4C, and 4D) is a circuit diagram detailing an electronics module portion of the system of FIG. 1;

FIG. 5 is a circuit diagram detailing an audio input module of the system of FIG. 1; and FIG. 6 is a circuit diagram of a wand setup module for configuring the controller portion of FIG. 2.

DESCRIPTION

The present invention is directed to a massaging system that is particularly effective in providing multiple modes of massaging and heating activity, and that is inexpensive to provide in a number of variants with minimal inventory complexity, with non-enabled features being transparent to users of the system. With reference to FIGS. 1–5 of the drawings, the present invention comprises a microcontroller based massage system 10 utilizing a plurality of vibrators 12 that are embedded in a massage pad 14 upon which a user lies or reclines. Each vibrator 12 is of conventional construction, and may comprise a small DC motor that rotates an eccentric weight, or if desired, a pair of eccentrics at opposite ends of the motor, the vibrators 12 being sometimes referred to herein as motors. Thus the vibrator 12 is caused to vibrate as the eccentric weight rotates. It will be understood that other forms of vibrators may be used. The pad 14 may also contain embedded heaters 16 and 18 for enhanced massaging. The pad 14 may be divided into foldable sections such as an upper section 20 (upper and lower back), a middle section 22 (hips and thighs), and a lower section 24 (calves).

In the exemplary configuration shown in FIG. 1, the pad 14 is body length, having twelve vibrators 12 arranged in groups of two and three motors in five zones, as follows: (1) a first zone 26 for the left side, center, and right side of the shoulder area; a second zone 28 for the left side, center, and right side of the lower back; a third zone 30 for the left and right hips; a fourth zone 32 for the left and right thighs; and a fifth zone 34 for the left and right calves. Particular ones of the zones and/or vibrators 12 are also sometimes referred to herein as Z1L, Z1C, Z1R, Z2L, Z2C, Z2R, Z3L, Z3R, Z4L, Z4R, Z5L, and Z5R, as further indicated in the drawings. Typically, the heaters 16 and 18 are centrally located in the shoulder and lower back areas 26 and 28. It will be understood that other groupings and numbers of zones are contemplated.

The system 10 is activated via a remote control device or wand 36 containing push buttons or keys and visual status indicators, as more fully described below. The wand 36 is removably coupled to an electronics module 37 in the massage pad via a cable 38, such as by a plug and socket coupling 39. The electronics module 37 is electrically connected to the vibrators 12 and the heaters 16 and 18 by a suitable wiring harness (not shown). The wand 36 and the massage pad 14 are powered through a power cable 40 having a power coupling 41 from either a wall transformer 42 or a battery (not shown), the latter affording portable operation. It will be understood that suitable batteries can be located within the pad 14. The control wand 36 provides a variety of functions or modes which are performed through the manipulation of buttons, keys or equivalent means, with corresponding indicators that designate selected functions and modes. The system 10 is operable in response to audio signals that are communicated through an audio input module 44 as further described below, the module 44 being connected to the pad 14 by an audio cable 45.

In some modes of operation, several of the buttons act as double or triple action keys, as further described herein. Specifically, as depicted in FIG. 2, power is turned on or off by a "PWR" button 46 centered within an area 47 designated "MASSAGE" and, when power is supplied, a light-emitting diode (LED) 48 is illuminated. The PWR or power button 46 also acts as a double action key for selecting massage duration, and for entering test and demonstration modes that are described below. The five zones 26–34 are individually actuable by pressing corresponding buttons 50, 52, 54, 56 and 58 within a "ZONES" area 60. Visual status indications are provided by respective lights 60L and 60R being disposed adjacent corresponding buttons or keys for indicating activation of associated left and right ones of the vibrators 12. The heaters 16 and 18 are operable at two levels and as further described below, by respective "HI" and "LO" heat buttons 62 and 64, within a "HEAT" area 66, with corresponding status indications by illumination of respective LEDs 68 and 70 that are adjacent the buttons 62 and 64. When both of the heaters 16 and 18 are present, the designation "HI" refers to the upper heater 16 and the designation "LO" refers to the lower heater 18. In this usage, the buttons 62 and 64 can act as triple action keys, sequentially selecting heat levels separately for the heaters 16 and 18 as described below. When only one heater element is present, the designations can optionally refer to high and low power levels of operation; alternatively, the buttons 62 and 64 can be configured as a single button.

WAVE, PULSE AND SELECT operational modes are provided by pressing respective buttons 72, 74 and 76, all enclosed within a modes area 78, SELECT being synonymous with manual operation. The buttons 72, 74, and 76 have respective LEDs 73, 75, and 77 associated therewith for indicating activation if the corresponding modes. Further ZIG-ZAG and CIRCLES operational modes are provided by pressing respective buttons 80 and 82 that are also in the modes area 78. A PROGRAM mode is provided by pressing a button 84 for presetting intensity level relations among the zones. The buttons 80, 82, and 84 have LEDs 81, 83, and 85 associated therewith. Additionally, a SWELL mode having smoothly undulating intensity is operative by pressing a corresponding button 86, with swell duration being controlled by a "+"/"−" pair of switch buttons 88 within a common area 90, another LED 89 being associated with the buttons 88. Similarly, "INTENSITY" and "SPEED" adjustments are provided by the pressing of respective pairs of "+"/"−" switch buttons 96 and 98 within a common area 100. Moreover, an AUDIO mode is provided by pressing a corresponding audio or music button 102 and operating the swell "+"/"−" switch buttons 88. Another LED 104 is associated with the audio button 102. The LEDs 60L and 60R are red; the LEDs 85, 89, and 104 are yellow; the LEDs 48, 73, 75, 77, 81, and 83, are red/green; and the LEDs 68 and 70 are red/yellow. The operations or effects of the various buttons of the wand 36 are described below.

FUNCTION KEYS

The system 10 is preferably configured for selective implementation of a master set of features and modes of operation, an illustrative and preferred master set being set forth herein. The function keys are in three major groups, namely selector, control, and mode. The selector keys include the power button 46, the upper and lower heater buttons 62 and 64 (These are multiple action keys that cycle to the next of two or three operating states on successive pressings.), and the five zone buttons 50–58. More specifically, the selector keys are used to turn on and off the massage and heater functions and select which massage zones are active.

The control keys include the up/down swell rate buttons 88 (labeled "+" and "−"), the up/down intensity buttons 90 (labeled "+" and "−"), the up/down speed buttons 98 (labeled "+" and "−"), and the audio button 102. These keys are used to control the massage intensity and the operating mode speeds.

The mode keys include the SELECT or manual button 76, the wave button 72, the pulse button 74, the zig-zag button 80, the circles button 82, the program button 84, the swell button 86, and the audio button 102. The mode keys are used to select the current massage operating mode as described further below.

Selector Keys

Regarding the specific selector keys, the power button 46 is a triple action key that cycles massage power through the states of "off", "on for 15 minutes" and "on for 30 minutes". The LED 48 is preferably bi-color for facilitating indication of the current massage power state. When an "on" state is selected, the massage system 10 will automatically turn off after operating for the selected time period. The first operation of the power button 46 after power is connected results in activation of the select(a) mode described below with zone 1 enabled. In subsequent restartings of the system 10 by the power button 46, the system 10 comes on configured as in the most recent usage.

The heater and massage power keys operate independently of each other. The heat button 62 acts as a triple action key for cycling the upper heater 16 through the states of "off", "on low" and "on high". The LED 68 indicates the "on low" state by yellow, and the "on high" state by red. When an "on" state is selected, the heater 16 will automatically turn off after 30 minutes. When the unit is configured for a single heater, the button 62 becomes the "high heat" key. In this mode it has a dual action selecting between the "off" and "on high" states and interacting mutually exclusively with the "low heat" key described below. The high state is at full power except as limited by a thermostat that is incorporated in the heater. The lower heater 18 is operated similarly as heater 16, using the other heat button 64. When the unit is configured for a single heater, this button 64 becomes the "low heat" key. In this mode the button 64 has a dual action, selecting between the "off" and "on low" states and interacting mutually exclusively with the "high heat" key (button 62) described above. In the low state, full power is applied for a warmup period of approximately 5 minutes, followed by continued operation at reduced power. As previously described, when only one heater element is present, the buttons 62 and 64 can be combined as a triple action key, and the LEDs 68 and 70 can also be combined.

The five buttons 50–58 act as dual action keys for enabling and disabling operation of the left and right vibrators 12 in the respective massage zones 26–34. Visual indicators associated with each key are activated when the corresponding zone is enabled. The massage action produced by the enabled motors is determined by the currently selected operating mode.

Control Keys

Regarding the control keys, the intensity buttons 96 are a pair of individually operated or toggled keys that increase and decrease, respectively, the intensity of the massage. Briefly pressing and releasing either key will change the intensity setting to the next step. Pressing and holding either key will continuously change the setting until the key is released or the upper or lower limit is reached. Since the intensity of the massage provides feedback to the user, there are no visual indicators associated with these keys.

The speed buttons 98 are a pair of individually operated or toggled keys increase and decrease, respectively, the speed at which certain of the operating modes change the massage action. Briefly pressing and releasing either key will change the speed setting to the next step. Pressing and holding either key will continuously change the setting until the key is released or the upper or lower limit is reached. Since the speed at which the massage action changes provides feedback to the user, there are no visual indicators associated with these keys.

The audio button 102 is a dual action key that enables or disables intensity control from an external audio source. When disabled, motor intensity is controlled by the intensity keys 96 in concert with the selector and mode keys as described above. When audio input is enabled, motor intensity is controlled by an amplitude envelope of the signal from the audio source, up to a maximum level as set by intensity key 96. A threshold level of operation is settable using the "+"/"−" swell switch keys 88. This setting is facilitated by the audio threshold indicator 104, a preferred adjustment having the indicator 104 just flashing at the loudest sounds from the audio source.

OPERATION MODES

As indicated above, operation is effected in several modes, including manual, wave, pulse, zig-zag, circles, program, swell, and audio, with further test and demonstration modes that exercise implemented ones of the other modes. The program, swell, and audio modes are secondary modes that alter operation of the other (primary) modes. The secondary modes are mutually exclusive. In the manual mode, effected by pressing the SELECT button 76, the vibrators 12 in enabled massage zones 26–34 run continuously. Pressing manual button 76 terminates any previous operating mode. The user may enable and disable the zones using the zone buttons 50–58, and customize the massage action by adjusting the intensity buttons 96, the swell button 86, and/or the audio button 102. More particularly, the following actions are produced:

(a) A single press of the button 76 enables independent zone selection using one or more of the zone keys 50, 52, 54, 56, 58. The select LED 77 is activated green. The zone selection is retained during operation of other modes as further described below. This select(a) mode is operative in all implementations of the system 10.

(b) A double (or second) press of the button 76 activates the select LED 77 red and only left side vibrators 12 in the selected zones.

(c) A triple (or third) press of the button 76 activates the select LED 77 orange and only right side vibrators 12 in the selected zones.

In the wave mode (WAVE button 72), the enabled massage zones 26–34 are cycled sequentially, and the user may enable and disable zones, adjust the massage intensity and adjust the cycling speed. When the wave mode button 72 is operated, the associated visual indicator 73 is activated, and the speed buttons 98 (which are contemplated to be active in all implementations of the system 10) are operative, in addition to the zone buttons 50–58, the intensity buttons 96, the swell button 86, and/or the audio button 102, for customizing the massage action. Pressing the wave button 72 also terminates any previous operating mode. Operation is as follows:

(a) A single press of the button 72 sequences activation of selected zones downwardly from the first zone (26) to the fifth zone (34) and upwardly from the fifth zone (34) to the first zone (26), and repeating. The wave LED 73 is activated green.

(b) A double (or second) press of the button 72 activates the wave LED 73 red and sequences activation of selected zones downwardly from the first zone (26) to the fifth zone (34) then skipping back to first, and repeating.

(c) A triple (or third) press of the button 72 reverses the sequencing of the wave(b) mode, upwardly from the fifth zone (34) to the first zone (26) then skipping back to the fifth, the wave LED being activated orange.

In the pulse mode (PULSE button 74), enabled massage zones are simultaneously pulsed on and off. The zone, intensity, speed, and audio keys (buttons 50–58, 96, 98, and 102) may be used to customize the massage action. Pressing the pulse key 74 terminates any previous mode. Operation is as follows:

(a) A single press of the button 74 cycles the vibrators 12 in enabled zones on and off at a duty cycle of approximately 50 percent, and at a rate corresponding to the current SPEED setting as defined by operation of the speed toggle buttons 98. The pulse LED 75 is activated green.

(b) A double (or second) press of the button 74 activates the pulse LED red and alternately cycles left and right side ones of the vibrators 12 in the enabled zones.

(c) A triple (or third) press of the button 74 causes operation as in the pulse(a) mode, but with a reduced duty cycle for producing a tapping or impact effect, the pulse LED 75 being activated orange. Entry of this mode is initially at maximum intensity and fastest speed, with reductions being effected by operation of the intensity and speed toggle buttons 96 and 98.

An important feature of the present invention is inclusion of the additional zig-zag, circles, program, and swell modes. In the zig-zag mode (ZIG-ZAG button 80), the following actions are produced to the extent that indicated zones are enabled as described above:

(a) A single press of the button 80 produces a "shoelace" pattern sequence of activation of the vibrators 12. More particularly, diagonal pairs of the vibrators 12 are sequentially activated in a repeating pattern such as Z1L and Z2R, Z2R and Z3L, Z3L and Z4R, Z4R and Z5L, followed by Z1R and Z2L, Z2L and Z3R, Z3R and Z4L, Z4L and Z5R. The zig-zag LED 81 is activated green.

(b) A double (or second) press of the ZIG-ZAG button 80 activates the zig-zag LED 81 red and produces an alternating zig-zag pattern of Z1L, Z2R, Z3L, Z4R and Z5L, followed by Z1R, Z2L, Z3R, Z4L and Z5R.

(c) A triple (or third) press of the ZIG-ZAG button 80 produces an alternating pattern in each zone that repeats several (such as four) times in that zone, then moves to next zone, the zig-zag LED being activated orange.

In the circles mode (CIRCLES button 82), enabled ones of the zones are activated as follows:

(a) A single press of the button 82 produces a clockwise circular pattern sequence of activation of the vibrators 12, the circles LED 83 being activated green. More particularly, a pattern of activated and idle states of the vibrators 12 is advanced sequentially through the zones Z1L, Z1R, Z2R, Z3R, Z4R, Z5R, Z5L, Z4L and Z3L, Z2L and returning to Z1L. In an exemplary form of the pattern, zones Z1L, Z3R, Z5R, and Z3L can be activated initially.

(b) A double (or second) press of the CIRCLES button 82 activates the circles LED red and produces the above sequence in a counterclockwise pattern.

(c) A triple (or third) press of the CIRCLES button 82 produces a figure-eight pattern variation of (a) by reversing the left and right designations of approximately half of the activated zones, the circles LED 83 being activated orange. For example, the designations of zones 3, 4, and 5 can be reversed left to right when any of them are activated along with both zone 1 and zone 2. When only one of zones 1 and 2 are active, only zones 4 and 5 would be reversed.

The user may adjust the massage intensity and the cycling speed, and may also select audio intensity control for each of the above modes.

The program mode (PGM button 84) provides customized settings of relative massaging intensity among the zones. Operation is as follows:

(a) A single press of the PGM button 84 enables changes in custom settings of individual zones and activates the program LED 85 (yellow). Each zone setting to be changed is effected by pressing the corresponding one of the zone buttons 50, 52, 54, 56, and 58, followed by using the INTENSITY toggle buttons 96 to adjust that level. The selected zone is indicated as being ready for its custom intensity setting by both left and right LED indicators 60L and 60R that are associated with the particular zone button blinking together. This step is repeated for each zone setting to be changed.

(b) A second press of the PGM button 84 restores normal operation, but with all zones following the above preset intensity settings, the program LED 85 remaining activated.

(c) A third press of the PGM button 84 returns the system to normal operation without the programmed settings. The programmed settings are retained in memory until power is disconnected or new program settings are made, notwithstanding the PWR key 46 being pressed off, or the timer that is associated therewith going off.

Further (fourth) pressings of the respective buttons 72, 74, 76, 80, 82, and 84 causes reentry of the submode (a) of the above modes.

The swell mode provides a smoothly increasing and decreasing massaging intensity modulation of the system 10. This mode, which modifies the operation of other modes, is activated by a single press of the SWL button 86; a second press restores normal operation. In the swell mode, the swell LED 89 (yellow) is activated and the period or cycle time of the modulation is controlled by the "+"/"−" swell buttons 88, the frequency having a range of from approximately 1 second to approximately 20 sec. The maximum intensity of the modulation is controlled by the intensity toggle keys 96 and/or the program mode, described above.

The audio mode provides massaging intensity that is coordinated with music loudness. This mode, which also modifies the operation of other modes, is activated by a single press of the audio button 102; a second press restores normal operation. When an audio source signal is fed into the system 10 as described below, the massaging intensity is modulated by an envelope amplitude of the signal. The "+"/"−" swell switch buttons 88 are operational in this mode for setting a threshold level of the audio envelope, and the swell LED 89 facilitates the adjustment, preferably flashing in response to the loudest portions of the audio signal.

The test mode is entered following a power off condition using a special combination of function keys before operating the PWR key 46, for example, by pressing the "+" portion of the intensity switch button 96, next quickly pressing the portion of the swell switch button 88 (the power LED 48 flashes alternately red and green), then quickly pressing the PWR key 46. The system 10 enters a composite sequence of all implemented ones of the above-described modes, and automatically returns to the power off condition after the test sequence is completed.

The demonstration (demo) mode is similarly entered following a power off condition, such as by pressing the "+" portion of the intensity switch button 96 up arrow, next quickly pressing the "−" portion of the speed switch button 98 (the power LED 48 flashes alternate colors such as orange and green), then quickly pressing the PWR key 46. The system 10 cycles through the composite sequence of modes as in the test mode, but recycles each time the sequence is completed. The demo mode is terminated by pressing the PWR button 46, or by disconnecting the power source. The system can be left unattended in the demo mode as an attraction to passers by.

SYSTEM ARCHITECTURE

Wand

Referring to FIGS. 3A and 3B, the control architecture of the massage system 10 is based on a microcontroller (MCU) 110, a key matrix 112, a system status matrix 114, and an erasable, electrically programmable memory (EEPROM) 116 in the wand 36, with other control electronics being in the electronics module 37 of the pad 14 as described below. An important feature of the present invention is that the EEPROM memory 116 operates in conjunction with conventional RAM and mask-programmed ROM of the MCU 110 as described below to facilitate efficient operation of the MCU in any of several optional configurations of the massaging system 10, while conserving inventory requirements. The EEPROM memory 116 provides non-volatile storage of configuration information when power is removed. The configuration information enables individual features to be selected from a master set that is fixed unchanged in the ROM of a multiplicity of the MCUs 110 to be used in a plurality of models of the system 10. The EEPROM also contains data that sets minimum and maximum motor intensity and maximum current consumption levels as further described below. It will be understood that the ROM and/or RAM can be external of the MCU 110, being generally associated therewith in any functional manner. Also, the EEPROM 116, which for the above identified purposes need only be programmable (PROM) or electrically programmable (EPROM), can be within the MCU 110.

In an important extension of the feature of storing the configuration data separately of firmware fixed in the ROM, a portion of the firmware of the MCU 110 provides means for programming the configuration EEPROM 116 after the control wand 36 is manufactured, thereby enabling post manufacturing configuration settings. Moerover, the preferred erasable feature permits subsequent changes to be made in the configuration settings. Programming is accomplished by connecting the control wand 36 to an external computer (PC) by means of a special interface box as described below in connection with FIG. 6. In the exemplary and preferred configuration of the wand 36 as described herein, the EEPROM 116 is a serial device that requires only a two-wire interface to the MPU 110 for both reading and writing the configuration data. A device using a standard serial interface known as the $I^2C$ bus protocol and being suitable for use as the EEPROM 116 is available as type AT24LC01A from Atmel Corp. of San Jose, Calif.

As further described below, the wand 36 is serially interfaced to the pad 14 for permitting the cable 38 to have only a few conductors, eight for example. A suitable device for use as the MCU 110 is a 4-bit KS57C0004 chip manufactured by Samsung Electronics. As shown in FIG. 3A, the MCU 110 is operated at 5-volts, being clocked using a conventional 4 Mhz crystal, and having a power-on reset circuit 117 connected thereto. The reset circuit 117 is voltage sensitive and contains hysteresis feedback to a base-emitter reference voltage for preventing oscillation near the switching voltage. The negative going trip point is set to approximately 4.0 V±10%. The wide operating voltage range of the MCU allows the reset trip point to be set this low.

The key matrix 112 has the various (22) buttons of the wand 36 electronically wired in a 6-by-4 matrix that is periodically scanned by the MCU chip 110. Keyboard scanning and LED display generation is performed in a multiplexed fashion that makes optimum use of the available processing time. The scanning algorithm uses leading edge detection with trailing edge filtering or debouncing. This provides rapid response to key pressings and eliminates multiple pressing detection due to slow contact closure or contact bounce. Without this feature, the alternate action selector keys might jitter on and/or off as each key was pressed or released. The scanning algorithm also looks for multiple key pressings and ignores any condition where two or more keys appear simultaneously pressed. This is required to eliminate "phantom key" detection caused by electrical shorting of the rows and columns of the matrix as certain combinations of keys are pressed. This key arrangement and scanning algorithm advantageously reduces the number of MCU input/output pins required to detect key pressings. Other key arrangements and scanning algorithms are also usable; however, the matrix approach is the most economical in terms of MCU resources. It will be understood that unused positions of the key matrix 112 are available for additional functions.

The system status matrix 114 contains the various LED power, heater and mode, zone and control indicators 48, 60L, 60R, 68, 70, 73, 75, 77, 81, 83, 85, 89, and 104. As described above, some of the LED indicators are multiple color devices; they have three terminals in the exemplary configuration described herein, each being connected in the matrix 114 as two separate devices. The system status matrix 114 is configured 4-by-8 and driven in a multiplexed fashion by MCU 110, each "column" of 4 LEDs being activated for about 24% of each display cycle. The period of the complete display cycle is short enough so that all activated indicators appear fully illuminated without any noticeable flicker. Flashing of selected indicators is a function performed by the control firmware independent of the display cycle.

The status indicator matrix 114 in combination with associated programming of the MCU advantageously reduces the number of MCU output pins required to illuminate the indicators. To further conserve MCU resources, the twelve drive signals of the system status matrix are shared with the key matrix 112. During the 2% of the display cycle when the display is inactive, six of the signals are used to scan the rows of the key matrix. Other visual indicator arrangements and driving algorithms are also possible; however, the matrix approach is the most economical in terms of MCU resources. It will be understood that unused positions of the indicator matrix are available for additional functions.

Electronics Module

Figure 4A:
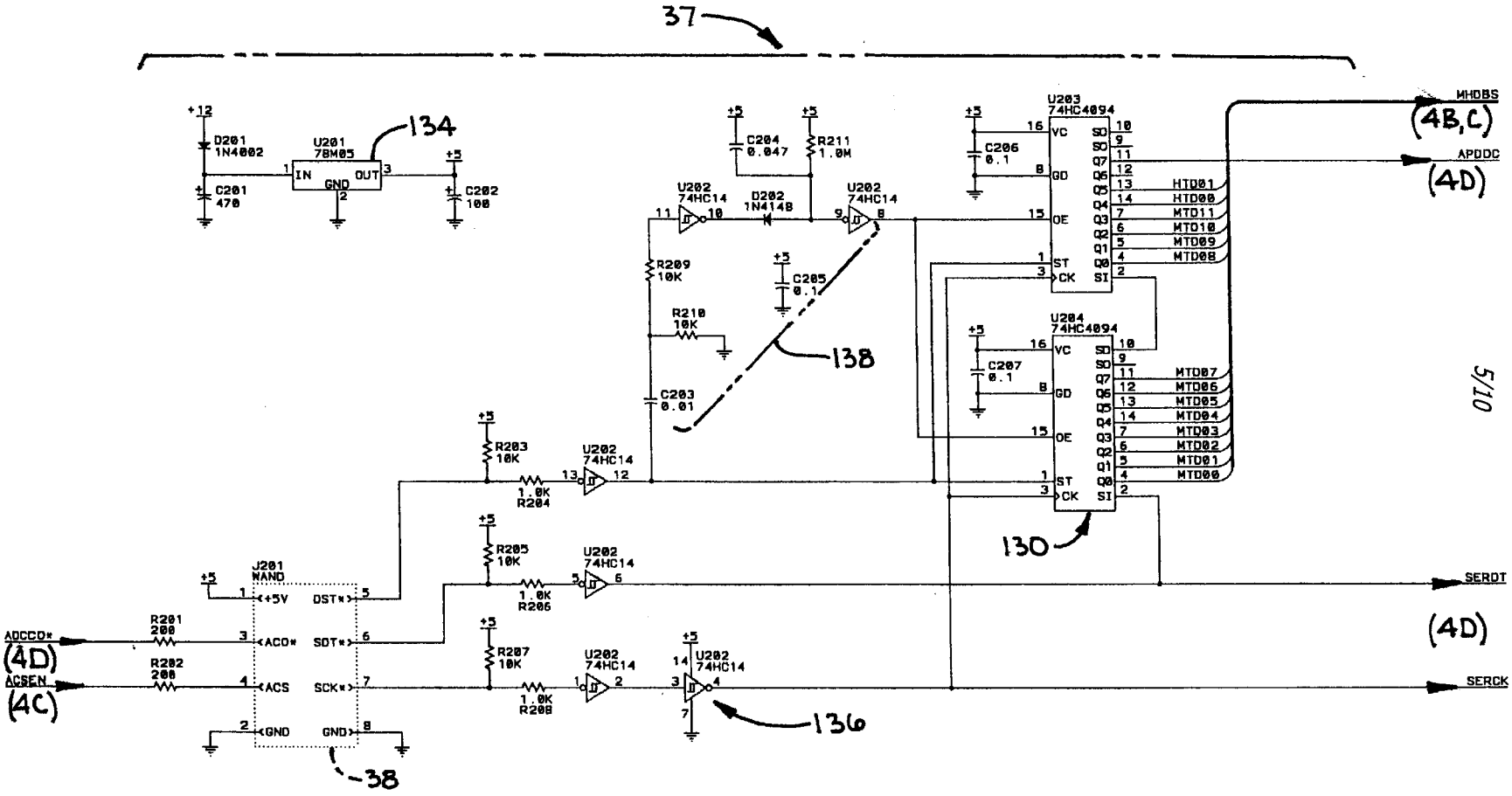
Figure 4B:
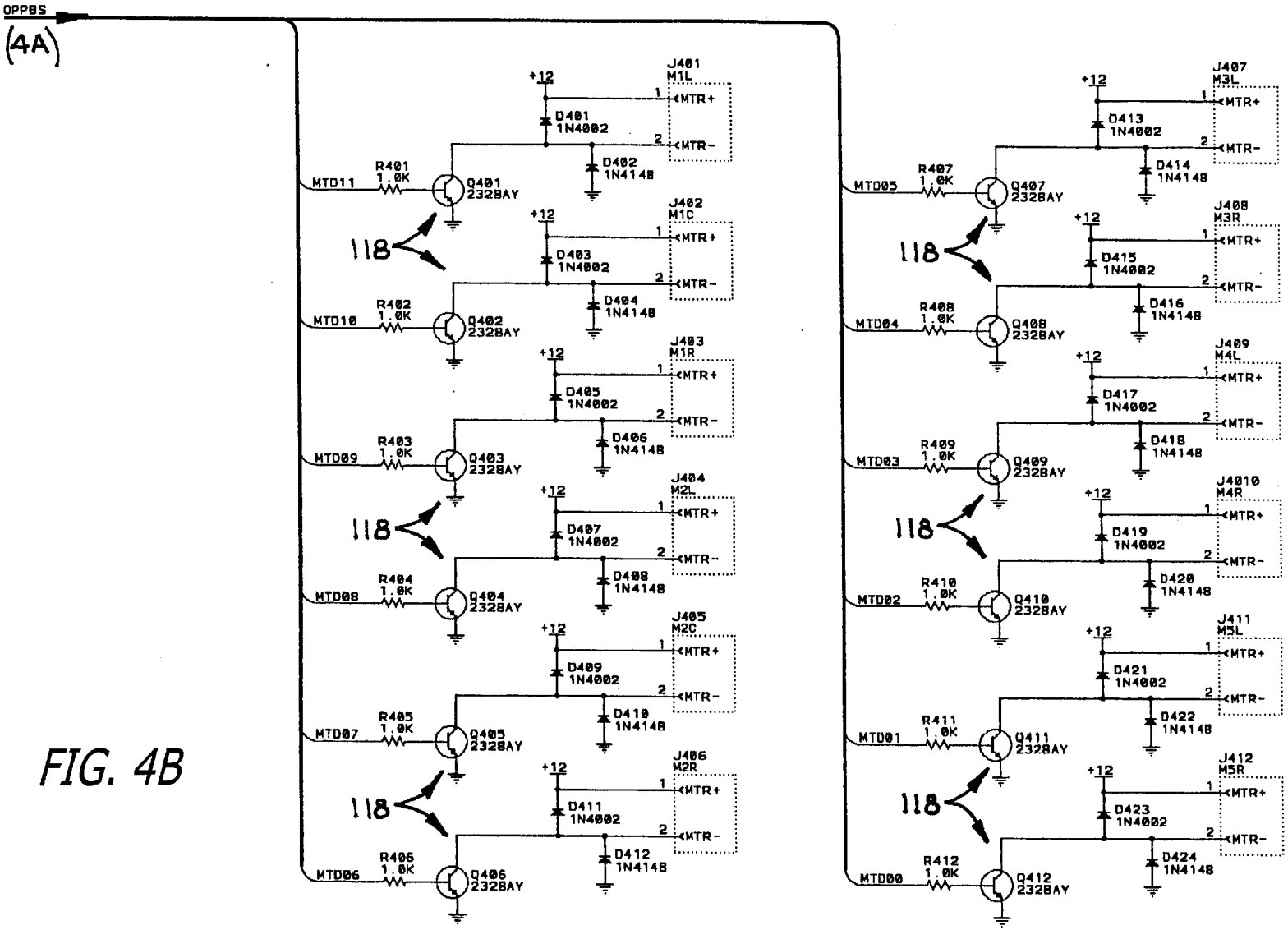

Referring to FIGS. 4A, 4B, 4C, and 4D, the electronics module 37 of the pad 14 includes motor drivers 118 for activating corresponding ones of the vibrators 12, and heater drivers 120 for powering the heaters 16 and 18 (FIG. 4B). The operating voltage is nominally 12 V RMS AC or 12–14 V DC. The module 37 also includes an audio detector 122 (FIG. 4D) that is responsive to the audio input module, a power detector 124 (FIG. 4C) for determining the presence of AC and DC power, a power voltage divider 126 (FIG. 4D) for monitoring the voltage of the power source, an analog to digital converter (ADC) 128 (FIG. 4D) for reading the audio detector 122 and the power voltage divider 126, and a shift register 130 (FIG. 4A) for feeding the motor and heater drivers 118 and 120 using serial data from the control wand 36. The module 37 further includes a fused power bridge 132 (FIG. 4C) that is fed from the power connection 41 to create an unregulated 12 VDC (12–18 VDC from an AC supply). The unregulated DC supply is used to drive the motors and power a 5-volt power regulator 134 (FIG. 4A) for powering the MCU 110 of the wand 36 and logic circuitry of the electronics module 37. The serial data to the shift register 130 is buffered by a Schmitt trigger circuit 136, the data being transmitted by conventional DST*, SDT*, and SCK* signals by the cable 38, wherein the symbol "*" represents assertion at ground level. The cable 38 also has conductors for +5V, GND(2), an ACO* signal from the ADC 128, and an ACS signal from the power detector 124, for a total of eight conductors.

The SDT* and SCK* signals are data and clock outputs from the MCU serial I/O port of the wand 36. During a byte transfer, the data changes on the negative edge of SCK* and is clocked into the shift register on the positive edge of SCK*. The clock period is 1 $\mu$s. The data from the MCU is transmitted in negated form. The signal DST* is the data strobe that transfers the shift register data to the output registers of the 74HC4094 shift register 130. The transfer is enabled while DST* is low. Each update of the shift register 130 consists of transmitting two data bytes and then pulsing DST* low for 2 $\mu$s. Each negative edge of the DST* triggers a re-triggerable pulse generator of the timer circuit 138 which enables the 74HC4094 output drivers. If the MCU stops updating the shift registers, the timer circuit 138 times out, disabling drive signals to the motor and heater drivers 118 and 120. This is a safety feature that protects against unwanted operation in case of MCU failure. Series resistors are included in the control wand and the wiring harness for reducing effects of ESD on the shift register control signals. When combined with the inter-wire capacitance in the cable 38, an RC network is formed that limits the maximum data transfer rate. Since the transfer rate is fixed by the MCU, the control cable 38 should be limited to a maximum length of 12 feet unless low capacitance cable is used.

Set-Up Unit

In an important feature of the present invention, the same conductors of the control cable 38 are used in reverse for sending configuration data to the EEPROM 116 using the MPU 110. The firmware provides means for programming the configuration EEPROM after the control wand is manufactured to allow post manufacturing configuration changes. With further reference to FIG. 6, programming of the EEPROM 116 is accomplished by plugging the control wand 36 into a special interface module or set-up unit 150 that is adapted for connection to a serial port of a conventional personal computer (PC), not shown. Under command from a PC program, the set-up unit 150 applies power to the wand 36 and activates a portion of the ROM firmware therein whereby a serial communication from the PC is received and corresponding data is serially relayed to the MCU 110, that data being serially stored in the EEPROM 116.

As shown in FIG. 6, the set-up unit 150 includes a microprocessor (MPU) 152 having an option switch matrix 153 coupled thereto, a termination for a counterpart of the control cable, designated 38', a power switch 154 for selectively powering the wand 36 when the wand is connected to the control cable 38' (disconnected from the pad 14), an 4-element inverter circuit 156 for coupling the MPU 152 to serial lines of the control cable 38' and for selectively activating an indicator LED 157, a serial interface connection 158 to a serial port of the PC, a serial driver 160 for coupling the MPU to the interface connection 156, and a power regulator 162 for powering the MPU 152, the switch 154, the inverter circuit 156, and the serial driver 160.

The set-up unit 150 operates by using the serial I/O port of the MPU 110 as an input device. After receiving setup data from the PC in a conventional manner such as by means of an ASCII script file, the set-up unit 150 applies power to the control wand 36 while holding SCK* low, thereby triggering the control wand ROM firmware to enter a configuration setup mode. The control wand 36 initializes itself and then waits for the set-up unit 150 to set SCK* high, which occurs one second after power is enabled by the switch 154. The MPU 152 then waits for a first byte request from the MCU 110, which requests the first byte by pulsing SDT* low for 2 $\mu$s after which the MPU 152 sends the data on DST* using SCK* as the input clock. The MPU 110 in the control wand 36 then stores the byte in the EEPROM 116 and requests the next byte from the set-up unit 150. When all the required bytes are transmitted by the set-up unit 150, power to the control wand 36 is cut off by the switch 154, thus completing the setup process.

Drivers

As shown in FIGS. 4A and 4B, the motor drivers 118 of the electronics module 37 are directly driven from respective register outputs of the shift register 130. Massage intensity (motor speed) is controlled by pulse width modulation (PWM) of the signals applied to the drivers 118. This, in turn, controls the average power applied to the motor. While a duty cycle range of 0–100% is possible, other factors limit the range to about 16–98%. These factors include motor stalling at low speeds, and subjective evaluation of minimum and maximum intensity levels. To reduce the audible noise generated by the PWM process, the pulse rate modulation frequency is set to between approximately 50 Hz and approximately 50 Hz. In the exemplary implementation of the PWM process as described further below, the frequency is set to 55.56 Hz.

Figure 4C:
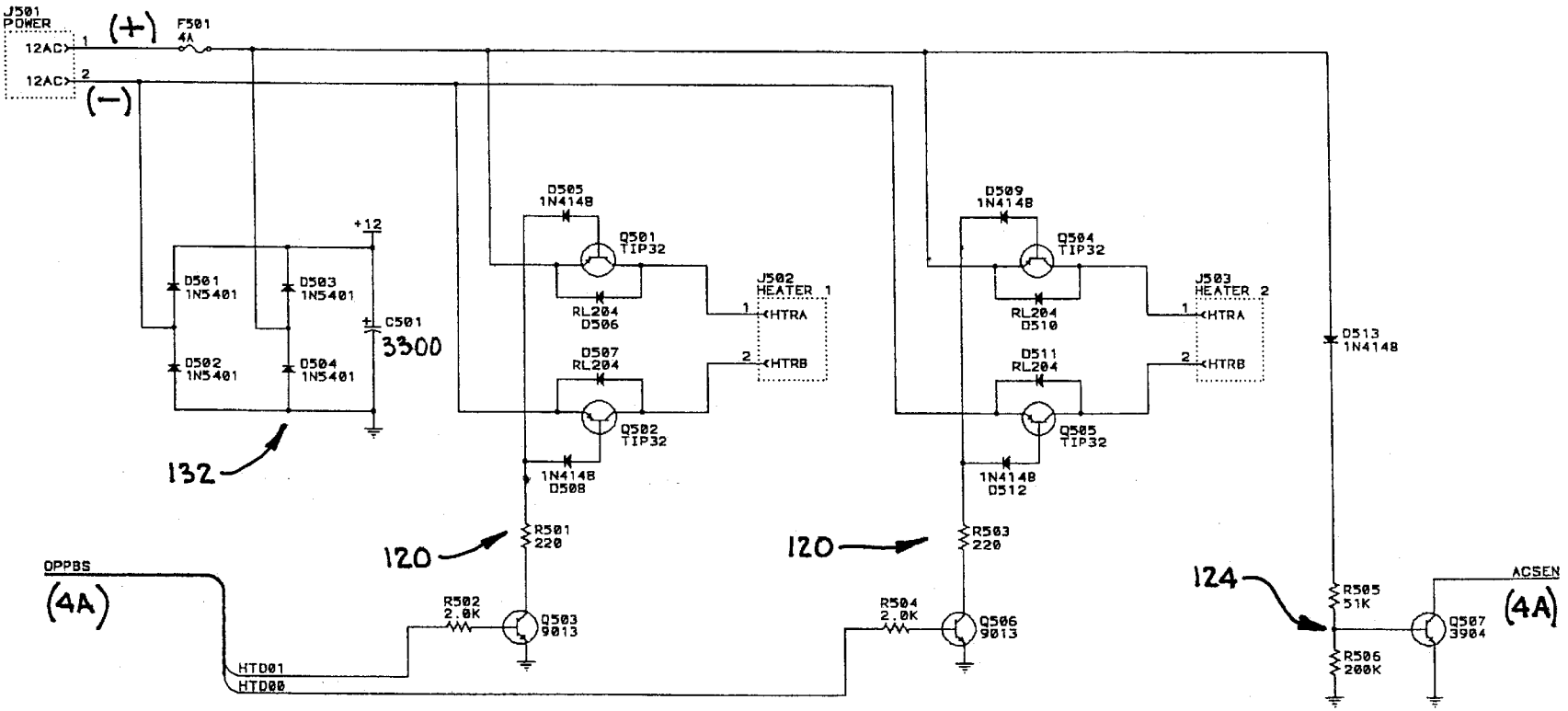

As shown in FIG. 4C, the heater drivers 120 are directly driven from additional register outputs of the shift register 130. The heaters 16 and 18 are driven directly from the power source, the drivers 120 being configured as non-polarized saturated transistor switching circuits. Heat level is controlled by pulse width modulation of the signals applied to the drivers in the same manner as for the motor drivers. For high heat, the duty cycle is set to 100%. For low heat, the duty cycle is set to 100% for a warm up interval and then is reduced to 50%. The warm up interval ranges from 0 to 5 minutes depending on the amount of time the heater was previously off. The heating pads 16 and 18 contain integral thermostats that limit the maximum operating temperature.

The shift register 128 (which can be conventionally implemented as a serially connected pair of 74HC4094 integrated circuits) is loaded by repetitive communication of serial data transfers from the control wand 36. Motor and heater control is performed using pulse width modulation (PWM), a communication occurring each time the on/off state of any driver is to change. This is normally a minimum of two communications per pulse width modulation (PWM) cycle or about 110 per second. A timer 138 which utilizes a portion of the Schmitt trigger circuit 136 is employed to automatically disable all drivers if a communication is not received at least once every 100 milliseconds. This protects the user in the event the control wand 36 becomes disconnected while power is applied to the electronics module 37.

Audio and ADC

Figure 4D:
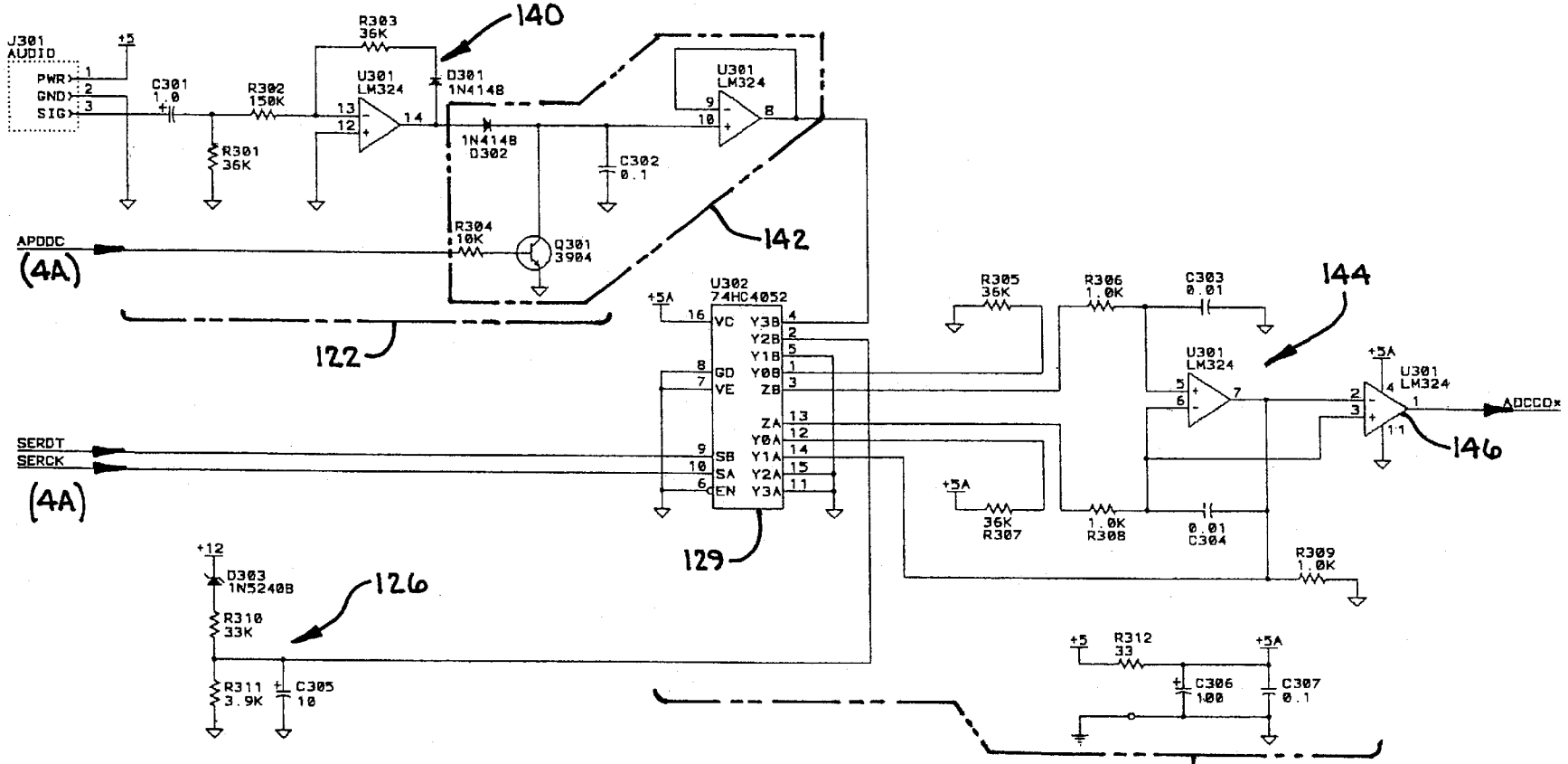

As shown in FIG. 4D, the audio detector 122 of the electronics module 37 includes a preamplifier 140 and a peak detector 142 for sampling the amplitude of incoming audio signals. The voltage level on the peak detector is read at the end of each PWM cycle and the detector is then discharged using a spare output bit (APDDC) of the shift register so that the detector may acquire the peak signal level in the next cycle. The periodic sampling and conversion of the peak detector output as described herein is effective to generate a digital envelope signal corresponding to an amplitude profile of the audio input. Thus the audio detector 122 and the ADC 128 cooperate with the MPU 110 and the shift register 130 to function as a digital envelope detector. Peak audio signal levels (as well as raw power supply voltage levels) are read by the ADC 128, which is implemented as a simple dual slope integrating circuit having a variable integration period, using a dual 4-channel multiplexer 129. The duration of the integration is adjusted in the audio mode by the "+"/"−" swell switch buttons 88 as described above, thereby changing the sensitivity of the ADC 128 to the audio signal. By increasing the integration time, the ADC becomes more sensitive and vice versa. The MCU 110 is programmed to provide to 80 different integration times. A total cycle time of the ADC is less than 600 microseconds to allow rapid signal measurement. The audio measurement uses one channel of the ADC 128, the other channel being used for measuring the power supply voltage as described below. The ADC is controlled in a multiplexed fashion using a pair of the shift register control signals. An integrated circuit device suitable for use as the multiplexer 129 in the ADC 128, designated 74HC4052, is commercially available from a variety of sources.

The ADC 128 is controlled by the shift register control signals SDT* (SERDT) and SCK* (SERCK), the high order output bit (APDDC) of the shift register 130 periodically resetting the peak detector 142 as described above. As further shown in FIG. 4D, the ADC consists of the analog multiplexor 129, an op-amp configured as a differential integrator 144, and an op-amp configured as a comparator 146. The operating sequence is as follows:

a) Integrator Zero Period. The output of the integrator 144 is set to zero prior to the start of the sample period. During the zero period SDT* and SCK* are set high (SERDT low and SERCK high) causing the integration capacitors (C303 and C304) to discharge through respective 1K input resistors (R306 and R308) setting the output of the integrator to zero. The integrator is held in this state for an interval sufficient for complete discharging of the capacitors. In the exemplary implementation described herein the interval is at least 180 $\mu$s, being one PWM time segment as defined below.

b) Integrator Sample Period. The voltage at the selected input is sampled and integrated for a fixed time period. During this period SDT* is set low (SERDT high) and SCK* is set either low for sampling the power supply level or high for sampling the audio peak level (SERCK low or high, respectively). The integration capacitors charge differentially through the 1k input resistors in that the resistor R308 is connected to ground and the other resistor R306 connected to the selected input voltage. The length of the integration period depends on which of the inputs is selected. When the power supply input is selected, the period is set by a parameter in the configuration EEPROM 116; when the audio input is selected, the period is set equal to a current music volume control setting code of the MCU 110.

c) Integrator Discharge Period. The integrator 144 is discharged to zero and the length of the discharge interval is measured by the MCU 110. During this period SDT* is set high and SCK* is set low (SERDT low and SERCK low) causing the integration capacitors to discharge through 37k resistors (R305+R305) and (R307+R308) with the resistance R307+R308 being connected to +5 V and the resistance R305+R306 connected to ground. The large resistor values lengthen the discharge period to provide enhanced measurement resolution. The output of the voltage comparator 146 is used by the MCU 110 to measure the discharge time. The output signal (ADCCO*) is low while the integrator output is greater than zero.

At the end of the audio peak level measurement, signal APDDC is set high for about 25 μs to discharge the peak detector 142.

As shown in FIG. 5, the audio input module 44 includes a microphone preamplifier 166 for amplifying a low-level microphone signal from an optionally connectable microphone 168 (see FIG. 1). An audio input jack 170 is series connected in an output signal path of the preamplifier 166 for passing high-level audio signals from an optional auxiliary source which can be a portable radio/tape player 172 as further shown in FIG. 1. The audio input module 144 further includes a headphone jack 174 for optionally connecting a headset 176 by which a user of the massage system 10 can privately monitor audio signals being fed to the audio detector 122 of FIG. 4D.

Power Monitoring

The massage system 10 is contemplated to be operated from a variety of electrical power sources, some of which can affect or impose restrictions on performance of the system. For example, one typical source is an AC line in combination with a low voltage transformer having limited available current and significant voltage drop as loads are applied, another contemplated source being an automobile electrical system. When the system is operated on DC being from an automobile storage battery, the current is not significantly limited and there is little or no voltage drop as loads are applied (such as by changing the number and duty cycle of the vibrators 12 being activated). Accordingly, the system 10 has a power source detector 124 that enables the MCU firmware to determine whether the system 10 is operating from an AC power source, to effect appropriate modification of driver activations by the MCU. The detector 124 is enabled and sensed once immediately following power-on. Under AC operation the available power is limited by the size of the transformer and the firmware must control the maximum power used by the motors, as described below with respect to the power control algorithm. Under DC operation, which is normally from an automobile storage battery, the system assumes that there is no limit to the power available; thus there is no constraint placed on the power to the motors. It will be understood that other combinations of power source limitations can exist, and appropriate detection of particular sources can be used to produce suitable modifications to driver activations. In operation, signal ACS (ACSEN from the detector 124) is sampled briefly by the MCU following power-on to determine if an AC or DC power supply is being used. The signal will be a square wave for an AC supply or a low level for a DC supply, provided that the DC supply connection is properly polarized as shown in FIG. 4C with the positive terminal at J501-1 and the negative terminal at J501-2.

PWM Cycle Pairs

All processing is performed synchronously with PWM cycles which have a period of 18,000 μs and a frequency of 55.56 Hz. To reduce processing overhead, keyboard scanning, display driving and ADC data reading is performed over two consecutive PWM cycles. The processing interval for these PWM cycle pairs has a period of 36,000 μs and a frequency of 27.78 Hz. Each PWM cycle is divided into 100 time segments of 180 μs each. All motor and heater state changes occur on a segment boundary. Thus the minimum motor intensity or heater power change is 1% of the maximum value. The time segments are numbered 99 through 0 starting at the beginning of the cycle. The sequence of events over the PWM cycles and pairs thereof is as follows:

1. PWM Processing (each single cycle). At the beginning of the cycle, any motor or heater that is not operating at 100% duty cycle is turned off. Motors are then turned on at the time segment corresponding to their current intensity level minus one. Thus if a motor is set to intensity level 62, it will be turned on at segment 61. To allow processing time for key scanning and ADC reading, the minimum active motor intensity is 8. Motors with intensities between 0 and 7 are not turned on. The intensity control will not allow the level to go below 8. Heaters set to low power are turned on at segment 49 (50% power). Heaters set to high power are left on at 100% duty cycle. When a heater is initially turned on at low power, the heater is run at high power for a warmup period which has a maximum duration of 5 minutes.

2. LED Driving. The LEDs of the system status matrix 114 (FIG. 3B) are driven in a multiplexed fashion over two consecutive PWM cycles. During the first cycle, columns 0 and 3 are driven (Q301 and Q303, respectively) and during the second cycle columns 1 and 3 are driven (Q302 and Q304, respectively). Each column is allocated 50 time segments providing a overall duty cycle of 25% except as described below. LEDs in columns 0 and 1 may be driven for less than 50 time segments to provide brightness modulation of the LEDs 60L and 60R corresponding to variable massaging intensity in the swell and audio modes. The modulation is controlled via the sinking (row) drivers (OPP40–43 and OPP50–53) to allow mixing of modulated and non-modulated LEDs. The connections of the LEDs 60L and 60R, respectively, in columns 0 and 1 advantageously produces the modulation in corresponding portions of seccessive PWM cycles. Modulated LEDs start the cycle in the off state and are turned on later in the cycle. Thus for a 60% intensity level, the modulated LED is turned off during the first 20 time segments and on for the last 30. Near the end of the drive cycle for LED column 3, six 20 μs time intervals are "borrowed" for scanning the keyboard. This reduces the duty cycle for this column by 0.33% which is transparent to ordinary observation.

3. Keyboard Scanning. The key matrix 112 is scanned at the end of the second PWM cycle during the drive of LEDs of column 3. The scan consists of six intervals during which the key rows are individually driven low via signals OPP40–43 and OPP50–51. During the low interval, the column information is read into MCU 110 using I/O lines P23–20.

4. Audio signal Level Reading. The current audio signal level is read at the end of each PWM cycle during time segments 7 through 4 (approximately). The value read is the peak value measured since the last reading. At the end of the reading, the peak detector is reset to zero for the next reading cycle.

5. Current Consumption Limiting. When the system 10 is operating from an AC power supply (wall transformer), the power voltage divider 126 (FIG. 4D) is employed to measure the power supply voltage as described above. When the voltage drops below a fixed threshold, the control firmware decreases the massage motor duty cycle to prevent exceeding the maximum current available from the transformer. The voltage is measured via the second channel of the audio signal ADC 128 as also described above. The voltage is sampled every other PWM cycle and the duty cycle adjustment is processed as for a critically damped servo loop to variably limit the PWM duty cycle so as to maintain a predetermined minimum of the supply voltage. The voltage measurement is read during time segments 3 through 0 (approximately) of the first PWM cycle during the drive of LED column 2. This activity alternates with keyboard scanning every other PWM cycle.

Electronic operation of the massaging system can be tested and verified with the aid of suitable equipment (not shown), using appropriate circuit nodes as test points. For example, PWM cycle synchronization is facilitated by using the positive edge of the I/O line P32 of the MCU 110 which can be terminated at a test point TP201 as shown in FIG. 3A. This edge occurs just prior to the start of audio peak ADC reading near the end of each cycle. The following negative edge occurs after the end of the ADC reading. The start of the next PWM cycle occurs approximately 1400 $\mu$s following the positive edge at TP201. Synchronization to the start of the first cycle of a PWM pair is facilitated by using the negative edge of OPP60 of the MCU 110 which can be terminated at a test point T202 as shown in FIG. 3B. Similarly, synchronization to the start of the second cycle of a PWM pair is facilitated by using the negative edge of OPP62 of the MCU 110, which can be terminated at a test point T203 as further shown in FIG. 3B. Both signals occur approximately 50 $\mu$s before the start of timing segment 99 in the associated PWM cycle.

Regarding the control programming of the MCU 110, the power control, speed control, default conditions, and a test mode of the present invention are more fully described below.

The power control: When operating from an AC transformer, the power available to drive the motors and heaters is limited by the maximum rating of the transformer. In addition, the rectified but unregulated DC voltage used to drive the motors varies according to the number of motor loads. With only one motor enabled, the DC voltage is closer to the AC peak value. As more motors are enabled, the DC voltage drops to near the AC RMS value. For AC operation, an appropriate transformer allows all motors to operate at full power without heaters and, with one or two heaters activated, allows reduced motor power, the transformer output power being preferably selected according to the number of heaters present in the system 10. The power control sequence includes the following steps:

1. If either of the audio or swell sub-modes are enabled, the intensity value is multiplied by the current audio envelope amplitude or swell phase as appropriate after compensating for the minimum value offset. (The envelope and phase values are scaled to range from zero to 1.0 so that the result is always less than or equal to the intensity control setting. If the program mode is enabled, the preprogrammed intensity settings are used (audio, swell, and program modes being mutually exclusive).

2. If the system 10 is powered from DC, the heater and motor voltages are assumed to be essentially constant regardless of load, control being transferred directly to step 5; otherwise, the power voltage as measured by the divider 126 and the ADC 128 is used for appropriately adjusting an over-current intensity value and associated servo loop (stability) parameters. The over-current intensity value is scaled between zero and 1.0 (the value for no over current condition).

3. The EEPROM parameters ACCFA and ACCFB are used for computing a PWM duty cycle correction factor (scaled between zero and 1.0), that value being multiplied by the over-current intensity value to obtain a motor intensity adjustment factor.

4. The minimum PWM duty cycle, typically 16%, is subtracted from the desired intensity setting from step 1, the result being multiplied by the adjustment factor from step 3, the minimum duty cycle being added back to the product. Each adjusted motor setting is between the minimum value for the current sub-mode and 100.

5. The respective PWM intensity settings are converted to PWM switching time values for periodic serial communication to the shift register 130 using timer interrupts of the MCU 110.

The speed control: The speed keys 98 adjust the step period for certain operating modes. Due to the manner in which speed changes are observed, the amount by which the step period is adjusted for each pressing of the SPEED key is a percentage of the current step period rather than a constant value. The percentage amount, P, is computed as the Nth root of R where R is the period range (maximum period minus minimum period) and N is the number of "SPEED" key steps allowed over R. Thus the step period change for each SPEED key pressing becomes $\pm S*P/100$ where S is the current step period.

The default conditions: When power is applied to the unit, the operating states are set as follows:

(a) Massage and heater power are set off;
(b) Zone 1 is selected in manual mode;
(c) Intensity is set to 60%;
(d) Speed is set to one second per step; and
(e) Swell and audio are disabled.

When the unit is turned on with massage power key 46, the previously selected zones, operating mode, intensity, speed, swell and audio states are retained. The massage timer, however, is reset to 15 minutes.

The test mode: The test mode is an automatic sequence of functions to test and/or demonstrate the capabilities of the unit. The procedure to evoke it and the functions it performs are as follows.

For evoking the test mode, the key entry sequence is (1) to press the POWER key, if necessary, until massage power is off (POWER visual indicator off) and (2) to press the INTENSITY+key followed, within 1 second, by the SWELL-key. At this point the POWER visual indicator rapidly flashes between red and green for 3 seconds. Pressing the POWER key during this interval starts the test mode. All other keys have their normal functions. It will be understood that other key entry sequences are contemplated. Of course, the "+"/"–" swell switch buttons 88 might not be present in some implementations of the system 10, in which case the key entry sequence would employ other buttons such as INTENSITY+, followed by SPEED–, then POWER.

The test mode produces a sequence of functions, each test function executing for one or more test steps, a time period of each step being determined by the SPEED key. The SPEED and INTENSITY keys are active during test mode and may be used to alter the test speed and motor intensity, respectively. The test mode, which can be terminated at any time by pressing power key 46, starts with all motors and visual indicators off cycles sequentially through each mode and variant thereof that is enabled by configuration data of the EEPROM 116. The test sequence ends with the massage and heater power off, and the unit may then be operated normally.

The Demonstration Mode. The demonstration mode duplicates the test mode, except continuing indefinitely until terminated as described above. From a powered down condition, a suitable key entry sequence is INTENSITY+, followed by SPEED−, then POWER. If the SPEED− key is used for test mode entry as described above, the demonstration mode key sequence can be INTENSITY+, followed by SPEED+, then POWER.

FIRMWARE

Architecture: The ROM firmware of the MCU 110 is divided into a set of mainline and timer interrupt modules that are activated during operation of the massaging system 10, and initialization modules that implement loading of the EEPROM 116 by the set-up unit 150. The mainline modules have direct control of the massage portion of the device. They sense key pressings and change the massage operation as a function of the current operating mode. The timer interrupt modules perform all of the time dependent sense and control tasks requested by the mainline modules plus processing of power, heater, intensity and speed key pressings. The mainline and interrupt modules execute in an interlaced fashion with the latter preempting the former whenever a timer interrupt occurs. Communication between the two is via RAM flags and control words.

Mainline Modules: The names and functions of the mainline modules defined in Appendix A are as follows:

Power-On Initialization (POIN). Executes once following application of main power (battery or AC) to the device to initialize hardware registers, initialize RAM contents, test for an AC or DC power supply, detect activation of the set-up mode, and then start the timer interrupt module for sensing operator input, etc.

Massage Power Resets (MPRS). Initializes the unit into Select Mode with Zone 1 enabled. Executed following POIN and TSMD (described below).

Massage Power Idle (MPID). Executes when the massage power is off to sense key pressings or events that would activate another mode. These include the POWER (key 46), the ZONE 1–5 (keys 50–58), and the two key sequences that enable the POWER key to turn the unit on in the test and demonstration modes.

Start Primary Operating Mode (STPM). Executes following MPID to branch to a primary mode section of the program.

Select Mode (SLMD). Executes when the unit is in Select Mode to run the selected zone motors and sense key pressings. The ZONE 1–5 keys toggle the state of the zones and the PULSE, WAVE, ZIG-ZAG, CIRCLES, and PROGRAM keys (keys 74, 72, and 80, 82, and 84, respectively) transfer execution to the appropriate module.

Pulse Mode (PLMD). Executes when the unit is in Pulse Mode to pulse the selected zone motors and sense key pressings. The ZONE 1–5 keys toggle the state of the zones and the SELECT, WAVE, ZIZ-ZAG, and CIRCLES, PROGRAM keys (keys 76, 72 and 80, 82, and 84, respectively) transfer execution to the appropriate module.

Wave Mode (WVMD). Executes when the unit is in Wave Mode to run the selected zone motors in wave fashion and sense key pressings. The ZONE 1–5 keys toggle the state of the zones and the SELECT, PULSE, ZIG-ZAG CIRCLES, and PROGRAM keys transfer execution to the appropriate module.

Zig-Zag Mode (ZZMD). Executes when the unit is in Zig-Zag Mode to run the selected zig-zag sequence and sense key pressings. The ZONE 1–5 keys transfer to SLMD with the selected zone enabled, and the WAVE, PULSE, SELECT, CIRCLES, and PROGRAM keys transfer to WVMD, PLMD, SLMD, CRMD, and PZMD, respectively [with previously selected zones enabled].

Circles Mode (CRMD). Executes when the unit is in Circles Mode to run the selected circular sequence and sense key pressings. The ZONE 1–5 keys transfer to SLMD with the selected zone enabled, and the WAVE, PULSE SELECT, ZIG-ZAG, and PROGRAM keys transfer to WVMD, PLMD, SLMD, ZZMD, and PZMD, respectively [with previously selected zones enabled].

Test Mode (TSMD). Executes after the test mode enable key sequence is entered and POWER is pressed. The module resets a demo flag and enters a program sequence that tests the heaters, motors and LEDs by cycling through all implemented combinations of a master set of the key enabled functions. The test mode skips those functions of the master set that are not implemented, according to parameters previously loaded into the EEPROM 116 as described above. When the test is complete, the demo flag is tested and the massage transducers and heaters are turned off with execution proceeding at MPRS if the demo flag was zero.

Demonstration Mode (TSMD). After the demonstration mode enable key sequence is entered and POWER is pressed, control is transferred to the TSMD program sequence with the demo flag set, thereby causing the test program sequence to be continuously repeated until the POWER button 46 is again pressed.

The various secondary modes (swell, audio, and program), which are implemented generally as described above, do not terminate the primary operating modes (select, pulse, wave, zig-zag, circles, test, and demo).

Set-Up Operations:

A personal computer (PC) can be connected by a serial port thereof to the set-up unit 150 as described above and provided with a simple utility program for transmitting configuration data to the EEPROM 116 wand 36. For example, in a DOS environment, the utility program can specify a port (such as COM1) and the filename of a script file containing the data to be transferred. Operation of the set-up unit 150 is evoked upon execution of the DOS command line that specifies the com port and the input script file. The input script file consists of a list of control parameter value definitions of the form (<parameter name> <value 1> [<value2> [<value 3> . . . ]]) as follows:

(HDRCD<header code>*)
(ZONEN<Z1 enable> <Z2 enable> <Z3 enable> <Z4 enable> <Z5 enable>)
(HTREN<heater 1 enable> <heater 2 enable>)
(SLMEN<select 1 enable> <select 2 enable> <select 3 enable>)
(PLMEN<pulse 1 enable> <pulse 2 enable> <pulse 3 enable>)
(WVMEN<wave 1 enable> <wave 2 enable> <wave 3 enable>)
(ZZMEN<zigzag 1 enable> <zigzag 2 enable> <zigzag 3 enable>)
(CRMEN<circle 1 enable> <circle 2 enable> <circle 3 enable>)
(SWMEN<swell enable>)
(MUMEN<music enable>)
(PGMEN<program enable>)
(PSITD<power status integration delay>)
(PSLTH<power status low threshold>)
(PSLHY<power status low hysteresis>)
(ACCFA<AC correction factor A>)
(ACCFB<AC correction factor B>)
(DFINL<default intensity level>)
(INCLL<intensity control low limit>)
(INMLL<music intensity low limit>)
(INSLL<swell intensity low limit>)

(END)

Values can be in hexadecimal form if preceded with "0x". Comments are allowed outside of the parenthetically delineated definitions. The various codes are defined as follows:

Header Code (HDRCD). Used to distinguish between parameter sets for different products. The wand control program compares this code with the expected value during mains power ON initialization. If the code is incorrect, the wand enters an error mode described below.

ZONEN defines five flags used for enabling the motor zones.

HTREN defines two flags for enabling the heaters.

SLMEN defines three flags used for enabling each submode of the select mode. Submode 1 must be enabled.

PLMEN defines three flags used for enabling each submode of the pulse mode.

WVMEN defines three flags used for enabling each submode of the wave mode.

ZZMEN defines three flags used for enabling each submode of the zigzag mode.

CRMEN defines three flags. Each are used for enabling the submode respectively of the pulse, wave, zigzag and circle modes. If all flags of any mode are 0, that mode is disabled.

SWMEN defines a flag used for enabling the swell mode.

MUMEN defines a flag used for enabling the music/audio mode.

PGMEN defines a flag used for enabling the program mode.

Power Status Integration Delay (PSITD) specifies the amount of time the power status signal is integrated (sampled) at each sampling period (every 36 ms). This allows compensation for external component values. Larger values increase the sensitivity of the measurement. The allowed value range is 0 to 80.

Power Status Low Threshold (PSLTH) specifies the low limit of the power status signal when an AC power supply is used. If the signal is below this value, the motor intensities are automatically lowered until the status signal rises above the threshold. This value interacts with PSKHY described below. The allowed value range is 0 to 80.

Power Status Low Hysteresis (PSLHY) specifies the hysteresis gap above PSLTH. If motor intensities are lowered because the power status signal is below PSLTH, the intensities will not return to normal until the power status is above PSLTH +PSLHY. The allowed value range is 0 to (80−PSLTH).

AC Correction Factor A (ACCFA) specifies coefficient A in the formula $$C=A+\text{SUM}\ (Mn*B \text{ for } n=1 \text{ to } 12)$$

where Mn is 0 if motor n is off or 1 if motor n is on, and B is ACCFB described below. The difference between the current and minimum intensity settings of each motor is multiplied by C and this value is used to set the actual motor intensity.

AC Correction Factor B (ACCFB) specifies coefficient B in the formula described above. The values of ACCFA and ACCFB must be set so that $A+(12*B)\leqq 255$.

Default Intensity Level (DFINL) specifies the mains power On setting of the intensity control. The allowed value range is 9 to 100.

Intensity Control Low Limit (INCLL) specifies the lowest setting of the intensity control. The allowed value range is 0 to 100. Values below 9 will cause the motors to stop at the minimum intensity setting.

Music Intensity Low Limit (INMLL) specifies the lowest intensity setting in music mode when no audio signal is present. The allowed value range is 0 to 100.

Swell Intensity Low Limit (INSLL) specifies the lowest intensity setting in swell mode. The allowed value range is 0 to 100. Values below 9 will cause the motors to stop at the bottom of the swell cycle.

The control parameter block in the EEPROM is followed by a negative checksum. During mains power ON initialization, the wand control program reads the parameters and checksum into the MCU. If the header code is correct and sum of the parameters and the checksum is zero, the parameters are assumed to be valid and the program enters idle mode. if the header is incorrect or the sum is non-zero, the parameters are assumed to be corrupted and the program enters an error mode wherein the yellow POWER LED 44 continuously flashes and normal operation is inhibited.

Although the present invention has been described in considerable detail with reference to certain preferred versions thereof, other versions are possible. For example, other types of transducers, including roller mechanisms, can be used for deforming the massage pad 14. Also, the EEPROM 116 can be loaded with data prior to assembly in the wand 36, and/or implemented for receiving data through the audio input module 44 or other means while the wand 36 is connected to the pad 14. Therefore, the spirit and scope of the appended claims should not necessarily be limited to the description of the preferred versions contained herein.

What is claimed is:

1. A computer controlled massaging system comprising:

(a) a pad for contacting a user of the system;

(b) a plurality of vibratory transducers for deflecting respective regions of the pad, each transducer being responsive to a transducer power signal;

(c) a microprocessor controller having associated therewith an input and output interface, and memory including read-only program memory (ROM), non-volatile programmable parameter memory (PROM), and variable memory (RAM);

(d) an array of input elements connected to the input interface for signaling the microprocessor in response to operator input, the signaling including signals for setting a plurality of operating modes, at least one region signal relating transducers to be activated in the plurality of modes, and signals for setting an intensity control value; and (e) a plurality of transducer drivers responsive to the output interface for producing, separately for each of the transducers, the power signal;

(f) the ROM having a set of instructions stored therein to be used by the microprocessor for implementing a master set of modes including a composite mode incorporating a plurality of other modes of the master set, and for interrogating the PROM; and (g) the PROM having parameters stored therein for enabling a predetermined complement of the master modes, wherein the microprocessor generates the plurality of operating modes in response to the input elements, to the exclusion of all but the predetermined complement and, when the predetermined complement includes the composite mode, the microprocessor generates the composite mode in response to the input elements while skipping those portions of the composite mode that are not included in the predetermined complement of the master modes.

2. The massaging system of claim 1, wherein the PROM is electrically programmable, and the microprocessor controller is configured for programming the PROM with the parameters in response to external signals.

3. The massage system of claim 2, wherein the PROM is a serial EEPROM having two signal connections only with the microprocessor for effecting both the programming of the configuration data therein and reading the data therefrom.

4. The massaging system of claim 2, wherein the microprocessor controller and the input elements are located in a control module external of the pad, the transducer drivers being located within the pad, the control module having a plug connection for signaling the transducer drivers, and wherein the plug connection is configured for the control module to receive the external signals when the plug connection is disconnected from the transducer drivers.

5. The massaging system of claim 4, further comprising a shift register connected between the plug connection and the transducer drivers, the shift register being repetitively loaded by serial data transfers using not more than two serial output signals and a buffer strobe signal from the microprocessor through the plug connection for defining respective pulse width modulation duty cycles of the transducer drivers.

6. The massaging system of claim 5, further comprising a timer for inhibiting outputs of the shift register when more than a predetermined interval passes between successive serial data transfers from the microprocessor to the shift register.

7. The massaging system of claim 5, further comprising an audio input connection for receiving an audio signal, an envelope detector for repetitively signaling measured amplitudes of the audio signal to the microprocessor, the system selectively activating the transducers variably in response to the envelope detector, the envelope detector comprising an integrating analog to digital converter (ADC) having a comparator output to the microprocessor, the ADC being cycled by the not more than two serial output signals.

8. The massaging system of claim 7, wherein the envelope detector comprises a peak detector, the peak detector being periodically reset by an output bit of the shift register.

9. The massaging system of claim 5, further comprising a heater element in the pad, and a heater driver connected between the shift register and the heater element for selectively activating the heater element at low and high power levels in response to serial data transfers from the microprocessor.

10. The massaging system of claim 9, wherein the heat control input has off, high, and low states for selectively powering the heater at high power, low power, and no power, and wherein the microprocessor controller is operative for activating the heater driver to power the heater element at high power when the heat control input is high, at no power when the heat control input is off, and at low power when the heat control input is low, except that when the heat control input is changed from off to low, the microprocessor controller is operative for powering the heater at high power for a warm up interval of time prior to the low power, the warm up interval being dependent on a time interval of the off state of the control input.

11. The massaging system of claim 1, wherein the program memory defines the master set of modes in accordance with substantially every state of the region signals and the mode signals, the composite mode being responsive to data of the parameter memory for skipping non-implemented modes and functions of the system.

12. A computer controlled massaging system comprising:

(a) a pad for contacting a user of the system;

(b) a plurality of transducers for deflecting respective regions of the pad, each transducer being responsive to a transducer power signal;

(c) a microprocessor controller having program and variable memory and an input and output interface;

(d) an array of input elements connected to the input interface for signaling the microprocessor in response to operator input, the signaling including an intensity control value and at least one region signal relating transducers to be activated; and (e) a plurality of transducer drivers responsive to the output interface for producing, separately for each of the transducers, the power signal;

(f) means for powering the microprocessor and the drivers from a first source of electrical power, the first source having a voltage drop as loads are added; and (g) means for limiting each of the power signals to a signal upper limit being inversely related to the source voltage for preventing overloading of the power source.

13. The massaging system of claim 12, for use additionally with a second power source, the second power source not having a voltage drop as great as the voltage drop of the first source as loads are added, the system further comprising a power detector for sensing whether the second power source is being used, the microprocessor being programmed for selectively limiting the power signals in response to the power detector.

14. The massaging system of claim 13, wherein one of the power sources is AC, the other DC, and wherein the power detector comprises an inverter having a square wave output when the power source is AC and a level output when the power source is DC, the microprocessor being responsive to the output of the power detector.

15. A computer controlled massaging system comprising:

(a) a pad for contacting a user of the system;

(b) a vibratory transducer for vibrating the pad, the transducer including a motor having a mass element eccentrically coupled thereto, the motor being responsive to a motor power signal;

(c) a control microprocessor having program and variable memory, and an input-output interface;

(d) an array of input elements connected to the microprocessor for signaling the microprocessor in response to operator input, the signaling including an audio mode signal;

(e) a motor driver responsive to the input-output interface for producing the power signal for the motor;

(f) an audio detector for detecting an audio envelope of an audio input signal, comprising:

(i) a peak detector having a reset input; and (ii) an analog to digital converter having a switching circuit, a differential integrator, and a comparator, the integrator having a sample connection configuration and a discharge connection configuration being defined in response to the switching circuit;

(g) wherein the microprocessor controller is operative for cycling the switching circuit and generating the motor power signal in response to the audio envelope.

16. The massaging system of claim 15, wherein the transducer is in an array of transducers, the motor driver is one of a corresponding plurality of motor drivers, the system further comprising:

(a) a serial communication interface between the microprocessor controller and the drivers, the interface having respective serial data, strobe, and clock outputs of the controller, and a converter input to the controller from the comparator;

(b) a shift register driven in response to the serial outputs for signaling the driver circuits and the reset input of the peak detector; and (c) wherein the switching circuit is operable in response to the serial outputs.

17. A computer controlled massaging system comprising:

(a) a pad for contacting a user of the system;

(b) a plurality of vibratory transducers for vibrating respective regions of the pad, each region having left and right ones of the transducers, each transducer being responsive to a transducer power signal;

(c) a microprocessor controller having program and variable memory and an input and output interface;

(d) an array of input elements connected to the input interface for signaling the microprocessor in response to operator input, the signaling including a plurality of region signals relating transducers to be activated, and a plurality of mode signals;

(e) a plurality of transducer drivers responsive to the output interface for producing, separately for each of the transducers, the power signal; and (f) the microprocessor controller being operative in response to the input elements for activating the transducers for operation thereof in a plurality of modes, and in a first composite mode wherein each of the plurality of modes is activated sequentially, the first composite mode automatically terminating upon completion thereof, and a second composite mode continuously repeating the first composite mode.

18. The massaging system of claim 17, wherein the signaling further includes signals for setting an intensity value, and wherein the transducers are activated at power levels responsive to the intensity control value in at least some of the modes, including at least one of the composite modes.

19. The massaging system of claim 17, wherein the signaling further includes a speed input for determining a rate of sequencing mode component intervals, and wherein, during at least one of the composite modes, the duration of operation in sequential activation of modes is responsive to the speed control value.

20. The massaging system of claim 17, wherein the input elements further define a heat control input, the system further comprising:

(a) a heater element in the pad;

(b) a heater driver responsive to the output interface for powering the heater, the microprocessor being further operative in response to the input elements for activating the heater element, and wherein the composite mode includes activation of the heater element.

21. The massaging system of claim 17, wherein at least some of the modes are altered upon repeated occurrences of same mode input signals.

22. The massaging system of claim 17, wherein the mode signals include a zig-zag signal, the microprocessor being operative in response to the zig-zag signal for activating alternating left and right ones of the transducers in sequential zones.

23. The massaging system of claim 22, wherein the microprocessor is operative in response to repeated occurrences of the zig-zag signal for selectively activating the transducers in:

(a) a shoelace pattern wherein diagonal pairs of the transducers are activated in a repeating pattern;

(b) a first alternating zig-zag pattern of left and right transducers in adjacent regions, followed by a second alternating pattern being a mirror image of the first; and (c) an alternating repetitive pattern in one region, the pattern sequentially advancing among the regions.

24. The massaging system of claim 17, wherein the mode signals include a circle signal, the microprocessor being operative in response to the circle signal for activating an alternating pattern of the transducers, the pattern periodically advancing in a closed path among the transducers.

25. The massaging system of claim 24, wherein the microprocessor is operative in response to repeated occurrences of the circle signal for selectively activating the transducers in:

(a) a circle pattern wherein the pattern is circular, advancing between the left transducers in one direction and the right transducers in the opposite direction;

(b) a circle pattern advancing oppositely of the previous pattern; and (c) a figure-eight pattern.

26. The massaging system of claim 17, wherein the mode signals include a program signal, the microprocessor being operative in response to the program signal for setting a relative power level for the transducers separately for each of the regions in response to the intensity control value and respective ones of the region signals.

27. The massaging system of claim 26, wherein the microprocessor is operative in response to repeated occurrences of the program signal for:

(a) changing custom settings of individual regions;

(b) permitting operation in other modes while maintaining relative power levels of the regions corresponding to the custom settings; and (c) permitting operation in other modes without the custom settings, the custom settings being preserved until being changed following a subsequent occurrence of the program signal.

28. The massaging system of claim 17, further comprising a non-volatile parameter memory for storing and signaling to the microprocessor controller particular functions being implemented in the system for utilizing a single set of programmed instructions in the program memory in variously configured examples of the massaging system.

29. The massaging system of claim 28, wherein the program memory defines the first composite mode as a master set of modes and functions in accordance with substantially every state of the region signals and the mode signals, the composite mode being responsive to data of the parameter memory for skipping non-implemented modes and functions of the system.

30. A method for configuring a massaging system comprising a pad having a plurality of vibrators in respective regions of the pad, a microprocessor control module including ROM firmware, non-volatile parameter memory, and a communication interface, and drivers for the vibrators being electrically connectable by the communication interface with the microprocessor, the method comprising the steps of:

(a) providing a set-up unit having means for receiving parameter data;

(b) connecting the set-up unit to the communication interface of the control module;

(c) feeding the parameter data to the microprocessor using the communication interface;

(d) writing the parameter data into the parameter memory using a portion of the ROM firmware, thereby to configure the system; and (e) disconnecting the set-up unit from the communication interface.

31. The method of claim 30, comprising the further steps of:

(a) loading the parameter data into the set-up unit using a script file;

(b) powering the control module from the set-up unit subsequent to the step of loading the parameter data; and (c) the step of feeding the parameter data comprises:

(i) momentarily asserting a signal of the communication interface simultaneously with the step of powering the control module for triggering the ROM firmware portion;

(ii) feeding portions of the data sequentially on the communication interface in response to respective request signals from the microprocessor; and (iii) removing power from the control module subsequent to the step of writing the parameter data thereby to terminate the configuring.

32. The method of claim 30, comprising the further step of connecting the drivers to the communication interface for enabling normal operation of the massaging system using the configuration data.

* * * * *